US009213281B2

(12) United States Patent
Ishigaya et al.

(10) Patent No.: US 9,213,281 B2
(45) Date of Patent: Dec. 15, 2015

(54) FIXING DEVICE WITH MECHANISM CAPABLE OF HEATING FIXING ROTARY BODY BY ELECTROMAGNETIC INDUCTION EFFECTIVELY AND IMAGE FORMING APPARATUS INCORPORATING SAME

(75) Inventors: Yasunori Ishigaya, Kanagawa (JP); Masahiro Samei, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/588,594

(22) Filed: Aug. 17, 2012

(65) Prior Publication Data

US 2013/0051876 A1 Feb. 28, 2013

(30) Foreign Application Priority Data

Aug. 23, 2011 (JP) ..... 2011-181215
Sep. 9, 2011 (JP) ..... 2011-196764

(51) Int. Cl.
*G03G 15/20* (2006.01)

(52) U.S. Cl.
CPC ..... *G03G 15/2053* (2013.01); *G03G 15/2017* (2013.01); *G03G 2215/2035* (2013.01)

(58) Field of Classification Search
CPC ..... G03G 15/2017; G03G 15/2053; G03G 2215/2035
USPC ..... 399/329, 334
See application file for complete search history.

(56) References Cited

U.S. PATENT DOCUMENTS

2007/0127959 A1* 6/2007 Tatematsu et al. ..... 399/329
2008/0253789 A1 10/2008 Yoshinaga et al.
2009/0060550 A1 3/2009 Seo
2009/0169232 A1 7/2009 Kunii et al.
2009/0290915 A1 11/2009 Baba
2009/0290916 A1* 11/2009 Baba ..... 399/329
2010/0061754 A1 3/2010 Ishigaya et al.
2010/0092220 A1 4/2010 Hasegawa et al.
2010/0092221 A1 4/2010 Shinshi et al.
2011/0064437 A1 3/2011 Yamashina et al.
2011/0091226 A1 4/2011 Ishigaya et al.
2011/0182634 A1 7/2011 Ishigaya et al.
2011/0217057 A1 9/2011 Yoshinaga et al.

(Continued)

FOREIGN PATENT DOCUMENTS

JP 2000-030850 1/2000
JP 2001-125407 5/2001

(Continued)

OTHER PUBLICATIONS

U.S. Appl. No. 13/427,276, filed Mar. 22, 2012 (unpublished).

*Primary Examiner* — Benjamin Schmitt
(74) *Attorney, Agent, or Firm* — Harness, Dickey & Pierce

(57) ABSTRACT

A fixing device includes a heat generator including a first non-conductive portion having a first width in an axial direction of the heat generator and a second non-conductive portion spaced apart from the first non-conductive portion in a circumferential direction of the heat generator and having a second width in the axial direction of the heat generator that is smaller than the first width of the first non-conductive portion. The heat generator is movable between a first heating position where the first non-conductive portion is disposed opposite an exciting coil unit and a second heating position where the second non-conductive portion is disposed opposite the exciting coil unit.

18 Claims, 12 Drawing Sheets

(56) References Cited

U.S. PATENT DOCUMENTS

| | | | | |
|---|---|---|---|---|
| 2011/0274473 | A1 | 11/2011 | Shinshi et al. | |
| 2011/0299899 | A1* | 12/2011 | Ishigaya et al. | 399/329 |
| 2012/0093532 | A1 | 4/2012 | Ishigaya et al. | |
| 2012/0093534 | A1 | 4/2012 | Waida et al. | |
| 2012/0148287 | A1* | 6/2012 | Samei et al. | 399/90 |
| 2012/0148317 | A1* | 6/2012 | Samei et al. | 399/328 |

FOREIGN PATENT DOCUMENTS

| | | | |
|---|---|---|---|
| JP | 2005148350 | A | 6/2005 |
| JP | 2005234000 | A | 9/2005 |
| JP | 2007-156065 | A | 6/2007 |
| JP | 2008-216390 | | 9/2008 |
| JP | 2009-058829 | A | 3/2009 |
| JP | 2009-282413 | | 12/2009 |
| JP | 2009282412 | A | 12/2009 |

* cited by examiner

| RECORDING MEDIUM | | PRINT MODE | |
|---|---|---|---|
| THICKNESS | PAPER WEIGHT ($g/cm^2$) | MONOCHROME | COLOR |
| THIN | - 80 | SEPARATE | SEPARATE |
| MEDIUM | 81 - 105 | SEPARATE | CONTACT |
| THICK | 106 - | CONTACT | CONTACT |

FIG. 22
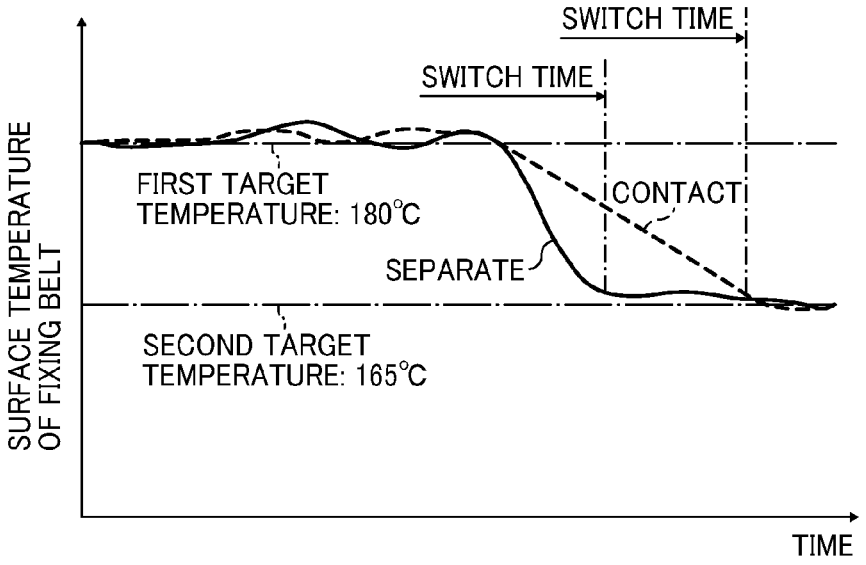
FIG. 23
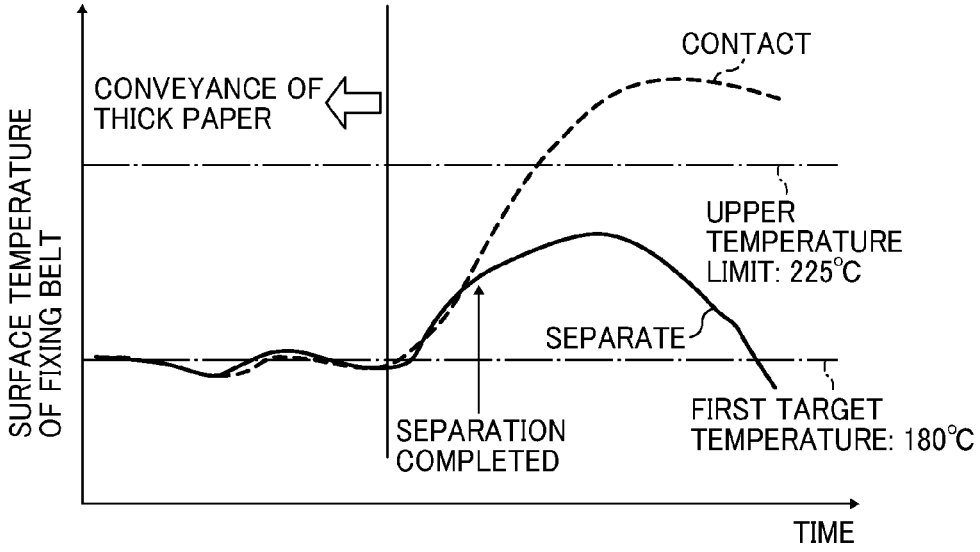
FIG. 24
| RECORDING MEDIUM | | APPARATUS α (A4 : 31PPM) | APPARATUS β (A4 : 41PPM) | APPARATUS γ (A4 : 51PPM) |
|---|---|---|---|---|
| THICKNESS | PAPER WEIGHT (g/cm$^2$) | | | |
| THIN | − 80 | SEPARATE | SEPARATE | CONTACT |
| MEDIUM | 81 − 105 | SEPARATE | CONTACT | CONTACT |
| THICK | 106 − | CONTACT | CONTACT | CONTACT |

FIXING DEVICE WITH MECHANISM CAPABLE OF HEATING FIXING ROTARY BODY BY ELECTROMAGNETIC INDUCTION EFFECTIVELY AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application Nos. 2011-181215, filed on Aug. 23, 2011, and 2011-196764, filed on Sep. 9, 2011, in the Japanese Patent Office, the entire disclosure of each of which is hereby incorporated by reference herein.

BACKGROUND OF THE INVENTION

1. Field of the Invention

Example embodiments generally relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such image forming apparatuses may employ a fixing device incorporating a fixing belt heated by electromagnetic induction to shorten a warm-up time required to warm up the fixing belt to a predetermined fixing temperature and a first print time required to output a recording medium bearing a fixed toner image after the image forming apparatus receives a print job.

For example, the fixing belt formed into a loop contacts an opposed pressing roller to form a fixing nip therebetween through which a recording medium bearing an unfixed toner image is conveyed. As a recording medium bearing an unfixed toner image is conveyed through the fixing nip, the fixing belt heated by electromagnetic induction by an exciting coil and a temperature sensitive magnetic member, together with the pressing roller, applies heat and pressure to the recording medium, thus melting and fixing the toner image on the recording medium. The temperature sensitive magnetic member separatably contacts the inner circumferential surface of the fixing belt and is disposed opposite the exciting coil via the fixing belt. As the temperature sensitive magnetic member receives a magnetic flux from the exciting coil, it heats the fixing belt by electromagnetic induction. Accordingly, the temperature sensitive magnetic member is isolated from the inner circumferential surface of the fixing belt with a predetermined gap therebetween until the fixing belt is heated to the predetermined fixing temperature, so that the temperature sensitive magnetic member does not draw heat from the fixing belt, thus facilitating quick heating of the fixing belt. After that, the temperature sensitive magnetic member comes into contact with the fixing belt. However, even while the temperature sensitive magnetic member is isolated from the fixing belt before the fixing belt reaches the predetermined fixing temperature, the temperature sensitive magnetic member may be constantly heated by the magnetic flux from the exciting coil, degrading heating efficiency for heating the fixing belt.

Another fixing device incorporates a fixing roller instead of the fixing belt and a conductive member instead of the temperature sensitive magnetic member. The conductive member situated inside the fixing roller is rotatable in the circumferential direction of the fixing roller and thus movable between the opposed position where the conductive member is disposed opposite the exciting coil via the fixing roller and the non-opposed position where the conductive member is not disposed opposite the exciting coil. The conductive member is at the non-opposed position until the fixing roller is heated to the predetermined fixing temperature. After that, the conductive member moves to the opposed position. However, the fixing roller incorporates a heat generation layer heated by electromagnetic induction by a magnetic flux from the exciting coil and a temperature sensitive magnetic layer having a predetermined Curie temperature that prevents overheating of the fixing roller. Since the heat generation layer is combined with the temperature sensitive magnetic layer, the temperature sensitive magnetic layer may draw heat from the heat generation layer, hindering quick heating of the fixing roller.

SUMMARY OF THE INVENTION

At least one embodiment may provide a fixing device that includes a fixing rotary body rotatable in a predetermined direction of rotation and including a first heat generation layer; a pressing rotary body pressed against the fixing rotary body to form a fixing nip therebetween through which a recording medium bearing a toner image is conveyed; a heat generator rotatable in a circumferential direction of the fixing rotary body to slide over an inner circumferential surface of the fixing rotary body and including a second heat generation layer; and an exciting coil unit disposed opposite the heat generator via the fixing rotary body to generate a magnetic flux that heats the first heat generation layer of the fixing rotary body and the second heat generation layer of the heat generator. The heat generator further includes a first non-conductive portion having a first width in an axial direction of the heat generator; and a second non-conductive portion spaced apart from the first non-conductive portion in a circumferential direction of the heat generator and having a second width in the axial direction of the heat generator that is smaller than the first width of the first non-conductive portion. The heat generator is movable between a first heating position where the first non-conductive portion is disposed opposite the exciting coil unit and a second heating position where the second non-conductive portion is disposed opposite the exciting coil unit.

At least one embodiment may provide a fixing device that includes a fixing rotary body rotatable in a predetermined direction of rotation and including a first heat generation layer. A pressing rotary body is pressed against the fixing rotary body to form a fixing nip therebetween through which a recording medium bearing a toner image is conveyed. A heat generator separatably contacts an inner circumferential surface of the fixing rotary body and includes a second heat generation layer. An exciting coil unit is disposed opposite the heat generator via the fixing rotary body to generate a magnetic flux that heats the first heat generation layer of the fixing rotary body and the second heat generation layer of the heat generator. A ferromagnet is disposed opposite the exciting coil unit via the heat generator and the fixing rotary body and partially movable between a first heating position where the ferromagnet causes the magnetic flux generated by the exciting coil unit to heat the first heat generation layer of the first rotary body and a second heating position where the ferromagnet causes the magnetic flux generated by the exciting coil unit to heat the first heat generation layer of the fixing rotary body and the second heat generation layer of the heat generator. A driver is connected to and moves the ferromagnet.

At least one embodiment may provide an image forming apparatus that includes any one of the fixing devices described above.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein:

FIG. 22 is a graph showing a relation between time and the surface temperature of the fixing belt incorporated in the fixing device shown in FIG. 15 when the fixing device switches from an enhanced temperature mode to a reduced temperature mode;

FIG. 23 is a graph showing a relation between time and the surface temperature of the fixing belt incorporated in the fixing device shown in FIG. 15 when the fixing belt overheats;

FIG. 24 is a lookup table showing a position of the heat generator moved by the separator incorporated in the fixing device shown in FIG. 15 based on a thickness of a recording medium and a recording medium conveyance speed;

Figure 1:
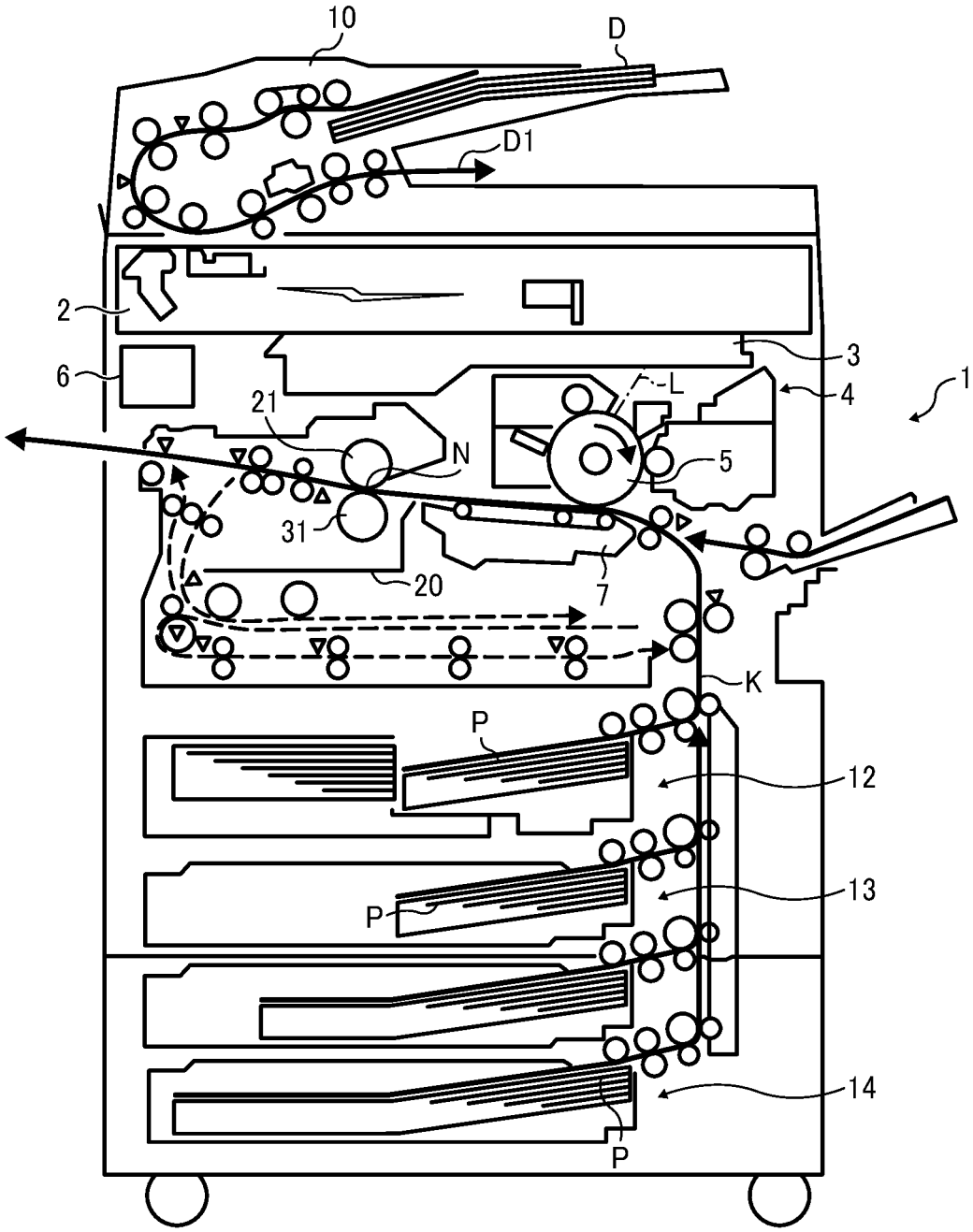
FIG. 1 is a schematic vertical sectional view of an image forming apparatus according to an example embodiment of the present invention.

The accompanying drawings are intended to depict example embodiments and should not be interpreted to limit the scope thereof. The accompanying drawings are not to be considered as drawn to scale unless explicitly noted.

DETAILED DESCRIPTION OF THE INVENTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic sectional view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. According to this example embodiment, the image forming apparatus 1 is a copier for forming an image on a recording medium by electrophotography.

Referring to FIG. 1, the following describes the structure of the image forming apparatus 1.

As illustrated in FIG. 1, the image forming apparatus 1 includes an auto document feeder 10 disposed atop the image forming apparatus 1; an original document reader 2 disposed in an upper portion of the image forming apparatus 1; an exposure device 3 disposed below the original document reader 2; an image forming device 4 disposed below the exposure device 3; a transfer device 7 disposed below the image forming device 4; paper trays 12, 13, and 14 disposed below the transfer device 7 in a lower portion of the image forming apparatus 1 and containing a plurality of recording media P (e.g., transfer sheets); and a fixing device 20 disposed downstream from the transfer device 7 in a conveyance direction of a recording medium P. The auto document feeder 10 feeds an original document D to the original document reader 2 that optically reads an image on the original document D to generate image data. The exposure device 3 emits light L onto a photoconductive drum 5 of the image forming device 4 according to the image data sent from the original document reader 2 to form an electrostatic latent image on the photoconductive drum 5. Then, the image forming device 4 visualizes the electrostatic latent image formed on the photoconductive drum 5 as a toner image. The transfer device 7 transfers the toner image formed on the photoconductive drum 5 onto a recording medium P sent from one of the paper trays 12 to 14. The fixing device 20 fixes the toner image on the recording medium P.

Referring to FIG. 1, the following describes the operation of the image forming apparatus 1 having the above-described structure to form a toner image on a recording medium P.

Conveyance rollers of the auto document feeder 10 convey an original document D placed on an original document tray in a direction D1 over the original document reader 2. As the original document D passes over the original document reader 2, the original document reader 2 optically reads an image on the original document D. For example, the original document reader 2 converts the read image into electric signals and then sends the electric signals to the exposure device 3. The exposure device 3 emits light L (e.g., a laser beam) onto the photoconductive drum 5 according to the electric signals sent from the original document reader 2, thus serving as a writer that forms an electrostatic latent image on the photoconductive drum 5.

The image forming device 4 performs a series of image forming processes including a charging process, an exposure process, and a development process on the photoconductive drum 5 as the photoconductive drum 5 rotates clockwise in FIG. 1. For example, a charger charges a surface of the photoconductive drum 5 in the charging process. The exposure device 3 emits light L onto the charged surface of the photoconductive drum 5 to form an electrostatic latent image thereon as described above in the exposure process. A development device visualizes the electrostatic latent image formed on the photoconductive drum 5 as a toner image in the development process. Thereafter, the transfer device 7 transfers the toner image formed on the photoconductive drum 5 onto a recording medium P sent from one of the paper trays 12 to 14 through a registration roller pair.

A detailed description is now given of the recording medium P sent to the transfer device 7.

One of the paper trays 12 to 14 is selected automatically according to the image data generated by the original document reader 2 or manually by a user using a control panel disposed atop the image forming apparatus 1. According to the description below, the uppermost paper tray 12 is selected. An uppermost recording medium P of the plurality of recording media P contained in the paper tray 12 is sent toward the registration roller pair through a conveyance path K.

Thereafter, the recording medium P reaches the registration roller pair. The registration roller pair temporarily halts the recording medium P, and then feeds the recording medium P to a transfer nip formed between the photoconductive drum 5 and the transfer device 7 at a time when the toner image formed on the photoconductive drum 5 is transferred onto the recording medium P.

After the transfer device 7 transfers the toner image onto the recording medium P, the recording medium P bearing the toner image is sent to the fixing device 20 through the conveyance path K. As the recording medium P bearing the toner image passes through a fixing nip N formed between a fixing belt 21 and a pressing roller 31 of the fixing device 20, the fixing belt 21 heats the recording medium P and at the same time the pressing roller 31 and the fixing belt 21 together apply pressure to the recording medium P, thus fixing the toner image on the recording medium P. After the recording medium P bearing the fixed toner image is discharged from the fixing nip N, the recording medium P is discharged onto an outside of the image forming apparatus 1. Thus, a series of image forming processes performed by the image forming apparatus 1 is completed.

Figure 2:
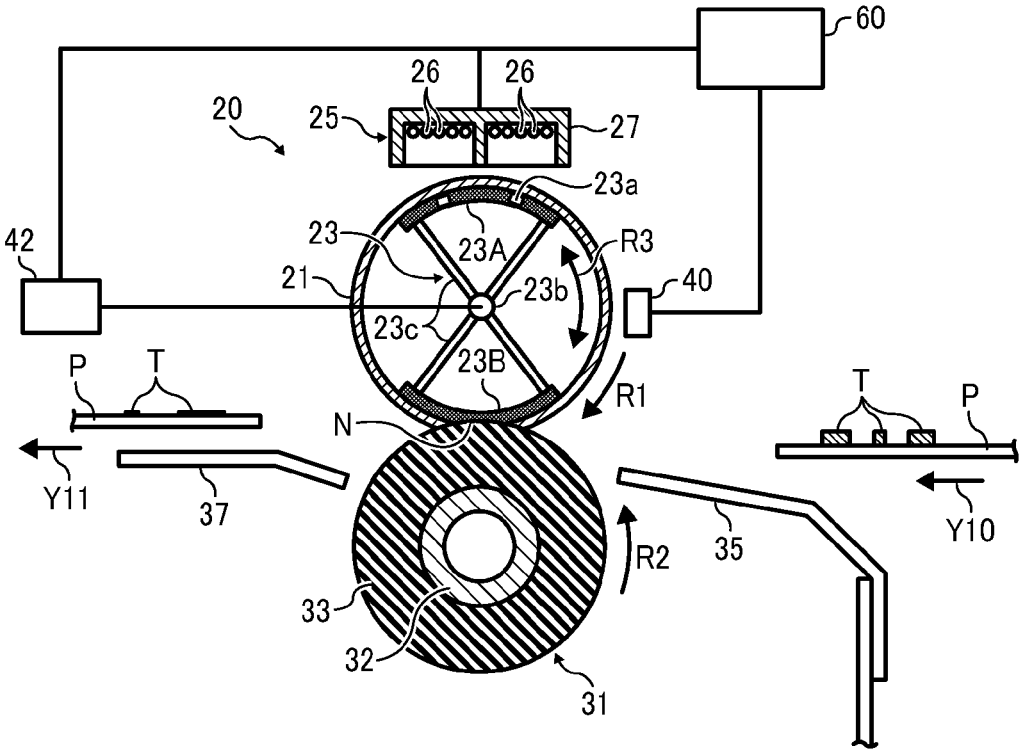
FIG. 2 is a vertical sectional view of a fixing device according to a first example embodiment incorporated in the image forming apparatus shown in FIG. 1.
Figure 3A:
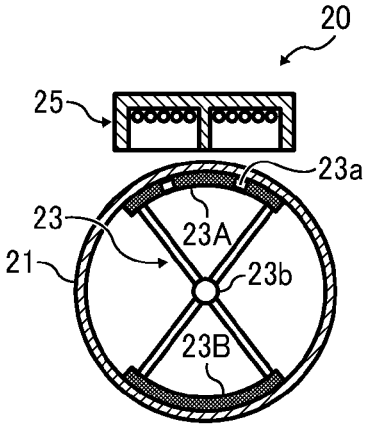
FIG. 3A is a partial vertical sectional view of the fixing device shown in FIG. 2 at a first heating position for heating a fixing belt incorporated therein.
Figure 3B:
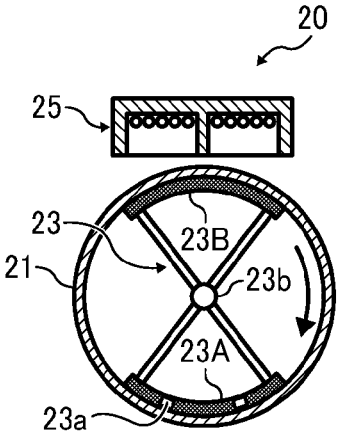
FIG. 3B is a partial vertical sectional view of the fixing device shown in FIG. 2 at a second heating position for heating the fixing belt.

Referring to FIGS. 2, 3A, and 3B, the following describes the structure and operation of the fixing device 20 according to a first example embodiment, which is installed in the image forming apparatus 1 described above.

FIG. 2 is a vertical sectional view of the fixing device 20. FIG. 3A is a partial vertical sectional view of the fixing device 20 at a first heating position for heating the fixing belt 21. FIG. 3B is a partial vertical sectional view of the fixing device 20 at a second heating position for heating the fixing belt 21. As shown in FIG. 2, the fixing device 20 (e.g., a fuser) includes the fixing belt 21 formed into a loop and serving as a fixing rotary body rotatable in a rotation direction R1; the pressing roller 31 serving as a pressing rotary body rotatable in a rotation direction R2 counter to the rotation direction R1 of the fixing belt 21 and pressed against the fixing belt 21 to form the fixing nip N therebetween; a heat generator 23 disposed inside the loop formed by the fixing belt 21; an exciting coil unit 25 serving as an induction heater disposed opposite an outer circumferential surface of the fixing belt 21; a temperature sensor 40 serving as a temperature detector disposed opposite the outer circumferential surface of the fixing belt 21; an upstream guide plate 35 disposed upstream from the fixing nip N in a recording medium conveyance direction Y10; and a downstream guide plate 37 disposed downstream from the fixing nip N in a recording medium conveyance direction Y11.

Figure 4A:
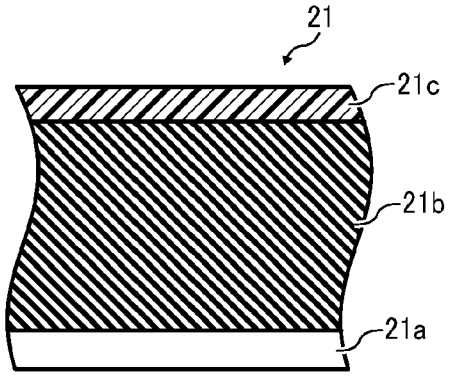
FIG. 4A is a vertical sectional view of the fixing belt shown in FIGS. 3A and 3B.

Referring to FIG. 4A, a detailed description is now given of a construction of the fixing belt 21.

FIG. 4A is a vertical sectional view of the fixing belt 21. The fixing belt 21 is a thin, flexible endless belt that rotates clockwise in FIG. 2 in the rotation direction R1. As shown in FIG. 4A, the fixing belt 21, having a thickness not greater than about 1 mm, is constructed of a first heat generation layer 21*a* serving as a base layer constituting an inner circumferential surface of the fixing belt 21 that slides over the heat generator 23; an elastic layer 21*b* coating the first heat generation layer 21*a*; and a release layer 21*c* coating the elastic layer 21*b*.

The first heat generation layer 21*a* is made of a conductive material having a decreased thermal capacity and has a thickness in a range of from about several microns to about several hundred microns, preferably in a range of from about ten microns to about several tens of microns. The first heat generation layer 21*a* generates heat by electromagnetic induction caused by the exciting coil unit 25 depicted in FIG. 2. The elastic layer 21*b*, having a thickness in a range of from about 100 micrometers to about 300 micrometers, is made of a rubber material such as silicone rubber, silicone rubber foam, and/or fluoro rubber. The elastic layer 21*b* eliminates or reduces slight surface asperities of the fixing belt 21 at the fixing nip N formed between the fixing belt 21 and the pressing roller 31 depicted in FIG. 2. Accordingly, heat is uniformly conducted from the fixing belt 21 to a toner image T on a recording medium P, minimizing formation of a rough image such as an orange peel image. According to this example embodiment, the elastic layer 21*b* is made of silicone rubber having a thickness of about 200 micrometers. The release layer 21*c*, having a thickness in a range of from about 10 micrometers to about 50 micrometers, is made of tetrafluoroethylene-perfluoroalkyl vinyl ether copolymer (PFA), polytetrafluoroethylene (PTFE), polyimide, polyetherimide, polyether sulfide (PES), and/or the like, facilitating separation of toner of the toner image T on the recording medium P from the fixing belt 21.

Referring to FIGS. 2, 3A, 3B, and 4B, a detailed description is now given of a construction of the heat generator 23.

Figure 4B:
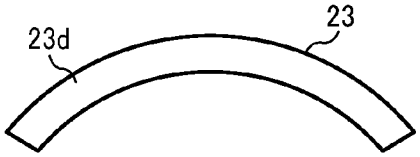
FIG. 4B is a vertical sectional view of a heat generator incorporated in the fixing device shown in FIG. 2.

FIG. 4B is a vertical sectional view of the heat generator 23. As shown in FIG. 2, the heat generator 23 is situated inside the loop formed by the fixing belt 21, facing the inner circumferential surface of the fixing belt 21. The exciting coil unit 25, that is, an induction heater, is disposed opposite a part of the outer circumferential surface of the fixing belt 21 with a gap provided therebetween. The inner circumferential surface of the fixing belt 21 is applied with a lubricant.

The heat generator 23 is disposed opposite the exciting coil unit 25 via the fixing belt 21 and rotatable and slidable over the inner circumferential surface of the fixing belt 21. For example, the heat generator 23 is divided into a first heat generation portion 23A and a second heat generation portion 23B that slide over the inner circumferential surface of the fixing belt 21. The first heat generation portion 23A and the second heat generation portion 23B are supported by support columns 23*c* mounted on a rotation shaft 23*b* connected to a heat generator driver 42 (e.g., a stepping motor). As the heat generator driver 42 rotates the heat generator 23 about the rotation shaft 23*b* bidirectionally in a rotation direction R3, the heat generator 23 moves between the first heating position shown in FIG. 3A where the first heat generation portion 23A is disposed opposite the exciting coil unit 25 via the fixing belt 21 and the second heat generation portion 23B is disposed opposite the pressing roller 31 depicted in FIG. 2 via the fixing belt 21 and the second heating position shown in FIG. 3B where the second heat generation portion 23B is disposed opposite the exciting coil unit 25 via the fixing belt 21 and the first heat generation portion 23A is disposed opposite the pressing roller 31 via the fixing belt 21.

The heat generator 23 also serves as a nip formation member that presses against the pressing roller 31 via the fixing belt 21 to form the fixing nip N between the fixing belt 21 and the pressing roller 31 through which the recording medium P bearing the toner image T is conveyed. For example, when the heat generator 23 is at the first heating position shown in FIGS. 2 and 3A, the second heat generation portion 23B of the heat generator 23 presses against the pressing roller 31 via the fixing belt 21, forming the fixing nip N between the fixing belt 21 and the pressing roller 31. By contrast, when the heat generator 23 is at the second heating position shown in FIG. 3B, the first heat generation portion 23A of the heat generator 23 presses against the pressing roller 31 via the fixing belt 21, thus forming the fixing nip N between the fixing belt 21 and the pressing roller 31. Since the first heat generation portion 23A and the second heat generation portion 23B have rigidity, even if they receive pressure from the pressing roller 31, they prevent substantial bending of themselves and the fixing belt 21, thus forming the desired fixing nip N between the fixing belt 21 and the pressing roller 31 that has a shape corresponding to a curvature of the pressing roller 31. Accordingly, the recording medium P is discharged from the fixing nip N according to the curvature of the pressing roller 31. Consequently, the recording medium P does not adhere to the fixing belt 21 after the fixing process and therefore separates from the fixing belt 21.

As shown in FIG. 4B, the heat generator 23 representing the first heat generation portion 23A and the second heat generation portion 23B is constructed of a second heat generation layer 23*d* made of a conductive material and heated by electromagnetic induction caused by the exciting coil unit 25. For example, the second heat generation layer 23*d* of the heat generator 23 generates heat by electromagnetic induction by an alternating magnetic field generated by the exciting coil unit 25, thus heating the fixing belt 21. That is, the heat generator 23 is heated by electromagnetic induction directly by the exciting coil unit 25 and the fixing belt 21 is heated by the exciting coil unit 25 indirectly via the heat generator 23. As described above with reference to FIG. 4A, since the fixing belt 21 includes the first heat generation layer 21*a*, the first heat generation layer 21*a* is also heated by electromagnetic induction directly by the alternating magnetic field generated by the exciting coil unit 25. That is, the fixing belt 21 is heated by electromagnetic induction directly by the exciting coil unit 25 and indirectly via the heat generator 23 heated by electromagnetic induction by the exciting coil unit 25, improving heating efficiency of the fixing belt 21.

The fixing belt 21 heats the recording medium P bearing the toner image T that slides over the outer circumferential surface of the fixing belt 21. The temperature sensor 40 (e.g., a thermistor and a thermopile) serving as a temperature detector is disposed opposite the outer circumferential surface of the fixing belt 21. A controller 60, that is, a central processing unit (CPU), provided with a random-access memory (RAM) and a read-only memory (ROM), for example, operatively connected to the temperature sensor 40 and the exciting coil unit 25 controls the exciting coil unit 25 based on the temperature of the fixing belt 21 detected by the temperature sensor 40 so as to adjust the temperature of the fixing belt 21 to a desired temperature (e.g., a fixing temperature).

For example, when the heat generator 23 is at the first heating position shown in FIGS. 2 and 3A, the first heat generation portion 23A serves as a heat generator that generates heat by electromagnetic induction caused by the exciting coil unit 25 and the second heat generation portion 23B serves as a nip formation member that presses against the pressing roller 31 via the fixing belt 21 to form the fixing nip N between the fixing belt 21 and the pressing roller 31. Conversely, when the heat generator 23 is at the second heating position shown in FIG. 3B, the second heat generation portion 23B serves as a heat generator that generates heat by electromagnetic induction caused by the exciting coil unit 25 and the first heat generation portion 23A serves as a nip formation member that presses against the pressing roller 31 via the fixing belt 21 to form the fixing nip N between the fixing belt 21 and the pressing roller 31. As shown in FIG. 2, the heat generator 23 further includes slits 23*a*, that is, first slits 23*a*1 and second slits 23*a*2 described below with reference to FIGS. 5A and 5B, serving as a non-conductive portion.

Figure 5A:
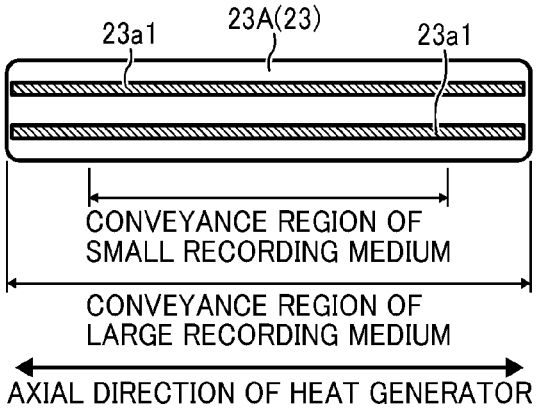
FIG. 5A is a top view of a first heat generation portion of the heat generator shown in FIG. 4B.
Figure 5B:
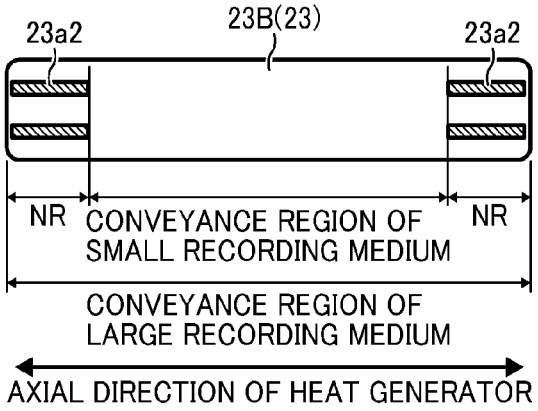
FIG. 5B is a top view of a second heat generation portion of the heat generator shown in FIG. 4B.

FIG. 5A is a top view of the first heat generation portion 23A of the heat generator 23 facing the exciting coil unit 25. FIG. 5B is a top view of the second heat generation portion 23B of the heat generator 23 facing the exciting coil unit 25. As shown in FIG. 5A, the first slits 23*a*1 serving as a first non-conductive portion are produced in the first heat generation portion 23A of the heat generator 23 throughout the substantially entire width of the first heat generation portion 23A in an axial direction thereof. As shown in FIG. 5B, the second slits 23*a*2 serving as a second non-conductive portion are produced in the second heat generation portion 23B of the heat generator 23 at each lateral end of the second heat generation portion 23B in an axial direction thereof. As the heat generator 23 rotates, the slits 23*a* move with respect to the exciting coil unit 25, changing an amount of heat and a heat generation distribution of the second heat generation layer 23*d* of the heat generator 23, a detailed description of which is deferred.

Referring to FIG. 2, a detailed description is now given of a construction of the exciting coil unit 25.

The exciting coil unit 25 includes an exciting coil 26 and an exciting coil core 27. The exciting coil 26 includes litz wire made of bundled thin wire wound around the exciting coil core 27 that covers a part of the outer circumferential surface of the fixing belt 21 and extending in an axial direction of the fixing belt 21. As an alternating electric current power supply supplies an alternating electric current to the exciting coil 26, the exciting coil unit 25 generates a magnetic flux toward the first heat generation layer 21*a* of the fixing belt 21 and the second heat generation layer 23*d* of the heat generator 23. The exciting coil core 27 is constructed of a ferromagnet, such as ferrite, having a relative permeability of about 2,500, which produces a magnetic flux toward the first heat generation layer 21*a* of the fixing belt 21 and the second heat generation layer 23*d* of the heat generator 23 effectively.

A magnetic flux shield made of non-magnetic metal such as aluminum and/or copper may be situated inside the loop formed by the fixing belt 21 at a position where the magnetic flux shield is disposed opposite the exciting coil unit 25 via the heat generator 23 and the fixing belt 21. Even if a magnetic flux generated by the exciting coil unit 25 penetrates the fixing belt 21 and the heat generator 23, the magnetic flux shield generates an eddy current that offsets the penetrating magnetic flux, reducing leakage of the magnetic flux and thereby improving heating efficiency of the fixing belt 21 and the heat generator 23.

Referring to FIG. 2, a detailed description is now given of a construction of the pressing roller 31.

The pressing roller 31 is constructed of a cylindrical hollow core 32 and an elastic layer 33 coating the core 32. The elastic layer 33, having a thickness of about 3 mm, is made of silicone rubber foam, silicone rubber, fluoro rubber, and/or the like. Optionally, a thin surface release layer made of PFA, PTFE, and/or the like may coat the elastic layer 33. The pressing roller 31 is pressed against the heat generator 23 via the fixing belt 21 to form the fixing nip N between the pressing roller 31 and the fixing belt 21. A gear engaging a driving gear of a driving mechanism is mounted on the pressing roller 31. Thus, the driving mechanism drives and rotates the pressing roller 31 counterclockwise in FIG. 2 in the rotation direction R2. Both lateral ends of the pressing roller 31 in an axial direction thereof are rotatably supported by side plates of the fixing device 20 via bearings, respectively. Optionally, a heat source, such as a halogen heater, may be disposed inside the pressing roller 31.

With the elastic layer 33 of the pressing roller 31 made of a sponge material such as silicone rubber foam, the pressing roller 31 exerts decreased pressure to the fixing belt 21 at the fixing nip N, thus decreasing bending of the heat generator 23. Further, the sponge material of the pressing roller 31 provides increased heat insulation, and therefore heat is not conducted from the fixing belt 21 to the pressing roller 31 easily, improving heating efficiency for heating the fixing belt 21.

Referring to FIG. 2, a detailed description is now given of a configuration of the upstream guide plate 35 and the downstream guide plate 37.

The upstream guide plate 35, that is, an entry guide plate, is disposed at an entry to the fixing nip N formed between the fixing belt 21 and the pressing roller 31 to guide a recording medium P bearing a toner image T conveyed from the transfer device 7 depicted in FIG. 1 to the fixing nip N. The downstream guide plate 37, that is, an exit guide plate, is disposed at an exit of the fixing nip N to guide the recording medium P discharged from the fixing nip N toward the outside of the fixing device 20. The upstream guide plate 35 and the downstream guide plate 37 are mounted on a frame (e.g., a cabinet) of the fixing device 20.

Referring to FIGS. 1 and 2, the following describes an operation of the fixing device 20 having the configuration described above to fix a toner image T on a recording medium P.

As the image forming apparatus 1 is powered on, the alternating electric current power supply (e.g., a high frequency power supply) supplies an alternating electric current to the exciting coil 26 of the exciting coil unit 25. Simultaneously, the pressing roller 31 is driven and rotated in the rotation direction R2. Accordingly, the fixing belt 21 is driven and rotated in the rotation direction R1 by friction between the pressing roller 31 and the fixing belt 21 at the fixing nip N. Thereafter, a recording medium P is sent from the paper tray 12 toward the transfer device 7 that transfers a color toner image formed on the photoconductive drum 5 onto the recording medium P. The upstream guide plate 35 guides the recording medium P bearing the unfixed toner image T in the direction Y10 to the fixing nip N formed between the fixing belt 21 and the pressing roller 31 pressed against the fixing belt 21. The fixing belt 21 heated by the exciting coil unit 25 heats the recording medium P. At the same time, the fixing belt 21 pressed against the pressing roller 31 by the heat generator 23 and the pressing roller 31 together exert pressure to the recording medium P, thus fixing the toner image T on the recording medium P. Thereafter, the recording medium P bearing the fixed toner image T is discharged from the fixing nip N and conveyed in the direction Y11.

Referring to FIGS. 5A to 9B, the following describes the configuration and operation of the fixing device 20 according to the first example embodiment in detail.

As shown in FIGS. 5A and 5B, the first slits 23*a*1 are produced in a part of the first heat generation portion 23A of the heat generator 23 and the second slits 23*a*2 are produced in a part of the second heat generation portion 23B of the heat generator 23. The first slits 23*a*1 and the second slits 23*a*2, that is, through-holes, serve as a first non-conductive portion and a second non-conductive portion, respectively. The heat generator driver 42, that is, a stepping motor connected to the rotation shaft 23*b* of the heat generator 23 as shown in FIG. 2, rotates the heat generator 23, moving the first slits 23*a*1 and the second slits 23*a*2 with respect to the exciting coil unit 25 and thus adjusting an amount of heat generated by the second heat generation layer 23*d* depicted in FIG. 4B of the heat generator 23 by electromagnetic induction and a heat generation distribution of the second heat generation layer 23*d* of the heat generator 23 in an axial direction thereof.

As shown in FIGS. 5A and 5B, the first slits 23*a*1 and the second slits 23*a*2 extend in the axial direction of the heat generator 23, that is, a direction of an eddy current induced in the second heat generation layer 23*d*. The plurality of first slits 23*a*1 and second slits 23*a*2 corresponds to a plurality of sizes of recording media P in the axial direction of the heat generator 23. The controller 60 depicted in FIG. 2 causes the heat generator driver 42 to rotate the heat generator 23, changing the slits to be disposed opposite the exciting coil unit 25 between the first slits 23*a*1 and the second slits 23*a*2 according to the size of the recording medium P in the axial direction of the heat generator 23.

For example, as shown in FIG. 5A, the first slits 23*a*1 extend throughout the substantially entire width of the first heat generation portion 23A of the heat generator 23 in the axial direction thereof that corresponds to a width of a large recording medium P, that is, an increased size recording medium, conveyed through the fixing nip N, that is, a conveyance region of the large recording medium P where the large recording medium P is conveyed through the fixing nip N. Conversely, as shown in FIG. 5B, the second slits 23*a*2 are created at both lateral ends of the second heat generation portion 23B of the heat generator 23 in the axial direction thereof that correspond to non-conveyance regions NR where a small recording medium P, that is, a decreased size recording medium, is not conveyed. For example, the width of the large recording medium P is a width of an A4 size recording medium in a landscape direction and a width of an A3 size recording medium in a portrait direction. The width of the small recording medium P is a width of an A4 size recording medium in a portrait direction.

As shown in FIG. 2, the controller 60 controls the heat generator driver 42 to rotate the heat generator 23 to switch the position of the heat generator 23 between the first heating position shown in FIGS. 2 and 3A where the first slits 23*a*1 of the first heat generation portion 23A are disposed opposite the exciting coil unit 25 and the second heating position shown in FIG. 3B where the second slits 23*a*2 of the second heat generation portion 23B are disposed opposite the exciting coil unit 25 according to the size of the recording medium P in the axial direction of the heat generator 23, that is, the width of the recording medium P. For example, as the small recording medium P is conveyed through the fixing nip N, both lateral ends of the fixing belt 21 in the axial direction thereof over which the small recording medium P is not conveyed may overheat because the small recording medium P does not draw heat from both lateral ends of the fixing belt 21. To address this circumstance, as the small recording medium P is conveyed through the fixing nip N, the heat generator driver 42 moves the second heat generation portion 23B of the heat generator 23 to the second heating position where the second slits 23*a*2 of the second heat generation portion 23B are disposed opposite the exciting coil unit 25. Accordingly, the second slits 23*a*2 reduce an amount of heat generated at both lateral ends of the second heat generation portion 23B in the axial direction thereof. Consequently, both lateral ends of the fixing belt 21 in the axial direction thereof contacting both lateral ends of the second heat generation portion 23B in the axial direction thereof do not overheat. That is, even if the first slits 23*a*1 of the first heat generation portion 23A or the second slits 23*a*2 of the second heat generation portion 23B are disposed opposite the exciting coil unit 25, they do not generate heat by a magnetic flux from the exciting coil unit 25 because the first slits 23*a*1 and the second slits 23*a*2 do not incorporate the second heat generation layer 23*d*.

When the small recording medium P is conveyed through the fixing nip N, the heat generator driver 42 moves the heat generator 23 to the second heating position shown in FIG. 3B where the second slits 23*a*2 of the second heat generation portion 23B are disposed opposite the exciting coil unit 25, reducing an amount of heat generated by the heat generator 23 in the non-conveyance regions NR where the small recording medium P is not conveyed. Accordingly, a reduced amount of heat is conducted from the heat generator 23 to the fixing belt 21 in the non-conveyance regions NR, preventing overheating of the fixing belt 21 at both lateral ends of the fixing belt 21 in the axial direction thereof. Even when the large recording medium P is conveyed through the fixing nip N, the heat generator driver 42 moves the heat generator 23 to a position slightly shifted from the first heating position shown in FIG. 3A where the first slits 23*a*1 of the first heat generation portion 23A are disposed opposite the exciting coil unit 25, thus attaining fine adjustment of an amount of heat generated by the heat generator 23 throughout the entire conveyance region where the large recording medium P is conveyed.

For example, in order to minimize an amount of heat generated by the second heat generation layer 23*d* of the heat generator 23 by electromagnetic induction by the exciting coil unit 25, the heat generator driver 42 moves the first slits 23*a*1 of the first heat generation portion 23A to a center position where the first slits 23*a*1 are disposed opposite a center of the exciting coil unit 25 in the rotation direction R1 of the fixing belt 21. Accordingly, in proximity to the first slits 23*a*1 of the first heat generation portion 23A, a smaller magnetic path is produced to keep clear of the first slits 23*a*1, reducing an amount of heat generated by the first heat generation portion 23A.

Conversely, in order to increase an amount of heat generated by the second heat generation layer 23*d* of the heat generator 23, the heat generator driver 42 moves the first slits 23*a*1 of the first heat generation portion 23A to a position where the first slits 23*a*1 are not disposed opposite the center of the exciting coil unit 25 in the rotation direction R1 of the fixing belt 21. Accordingly, the first heat generation portion 23A produces a relatively great magnetic path that increases an amount of heat generated by the first heat generation portion 23A. Changing an amount of heat generated by the heat generator 23 as described above achieves fine adjustment of heating of the fixing belt 21.

According to the example embodiment described above, as shown in FIGS. 5A and 5B, the two types of slits, that is, the first slits 23*a*1 and the second slits 23*a*2, are produced in the first heat generation portion 23A and the second heat generation portion 23B that correspond to two sizes of recording media P, respectively. Alternatively, three or more types of slits may be produced in the heat generator 23 to correspond to three or more sizes of recording media P.

Figure 6:
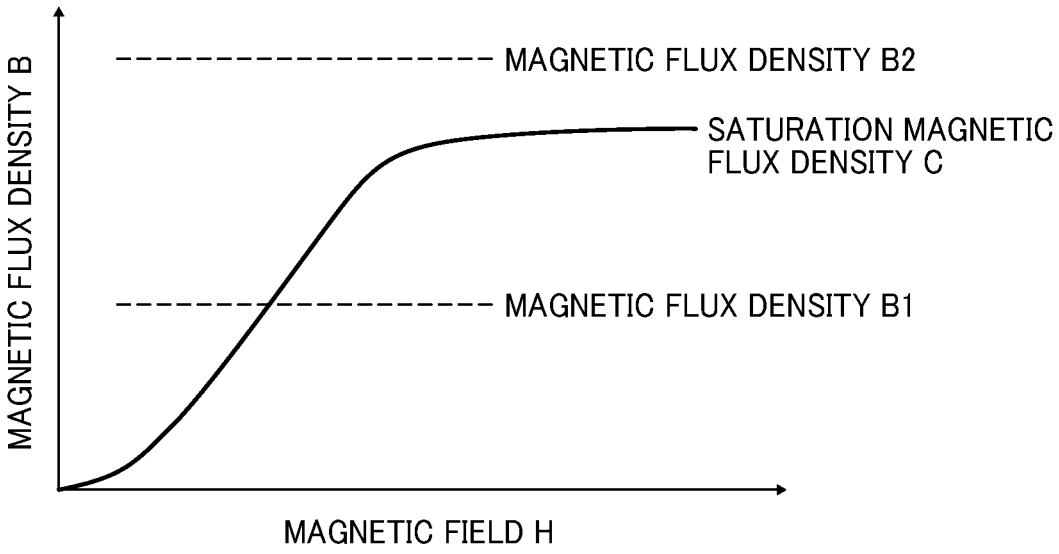
FIG. 6 is a graph illustrating a relation between a magnetic field generated in the vicinity of a first heat generation layer of the fixing belt shown in FIG. 4A and a magnetic flux density of a magnetic flux applied from an exciting coil unit incorporated in the fixing device shown in FIG. 2 to the first heat generation layer of the fixing belt.

Referring to FIG. 6, a detailed description is now given of a configuration of the first heat generation layer 21*a* of the fixing belt 21 depicted in FIG. 4A.

The magnetic flux density of a magnetic flux applied from the exciting coil unit 25 to the first heat generation layer 21*a* of the fixing belt 21 is greater than the saturation magnetic flux density thereof as shown in FIG. 6. FIG. 6 is a graph illustrating a relation between a magnetic field H generated in the vicinity of the first heat generation layer 21*a* of the fixing belt 21, that is, a magnetic field generated by the exciting coil unit 25, and a magnetic flux density B of a magnetic flux applied from the exciting coil unit 25 to the first heat generation layer 21*a* of the fixing belt 21. For example, the first heat generation layer 21*a* is made of a ferromagnetic material such as iron, nickel, cobalt, and/or an alloy of these. As shown in FIG. 6, as the size of the magnetic field H increases, the magnetic flux density B also increases. However, when the magnetic field H has a predetermined size, the magnetic flux density B is saturated at a saturation magnetic flux density C. As the controller 60 depicted in FIG. 2 controls the exciting coil unit 25 to apply a magnetic flux of a magnetic flux density B1 smaller than the saturation magnetic flux density C, the magnetic flux generated by the exciting coil unit 25 reaches the first heat generation layer 21*a* of the fixing belt 21 but does not penetrate it. Conversely, as the controller 60 controls the exciting coil unit 25 to apply a magnetic flux of a magnetic flux density B2 greater than the saturation magnetic flux density C, the magnetic flux generated by the exciting coil unit 25 penetrates the first heat generation layer 21*a* of the fixing belt 21 and reaches the second heat generation layer 23*d* of the heat generator 23.

The first heat generation layer 21*a* of the fixing belt 21 is made of a magnetic shunt metal material having ferromagnetism such as iron, nickel, cobalt, and/or an alloy of these, preferably a magnetic shunt metal material having property changing from ferromagnetism to paramagnetism such as iron, nickel, silicone, boron, niobium, copper, zirconium, cobalt, and/or an alloy of these. With the first heat generation layer 21*a* made of the above-described material, when a Curie temperature of the first heat generation layer 21*a* is set to around a predetermined fixing temperature, the fixing belt 21 is not heated to above the fixing temperature. Accordingly, ripple in the temperature of the fixing belt 21 is decreased even when the plurality of recording media P is conveyed through the fixing nip N continuously, stabilizing fixing performance and gloss application to the fixed toner image T on the recording medium P.

Further, when a Curie temperature of the first heat generation layer 21*a* is set to not greater than an upper temperature limit of the fixing belt 21, the non-conveyance region NR on the fixing belt 21, provided at each lateral end of the fixing belt 21 in the axial direction thereof, through which small recording media P do not pass does not overheat to above the upper temperature limit of the fixing belt 21. Accordingly, even when small recording media P, which have a small width in the axial direction of the fixing belt 21 and therefore do not pass through the non-conveyance regions NR of the fixing belt 21, are conveyed to the fixing nip N continuously, the fixing belt 21 may not overheat due to lack of heat conduction from the non-conveyance regions NR thereon to the small recording media P.

Figure 7:
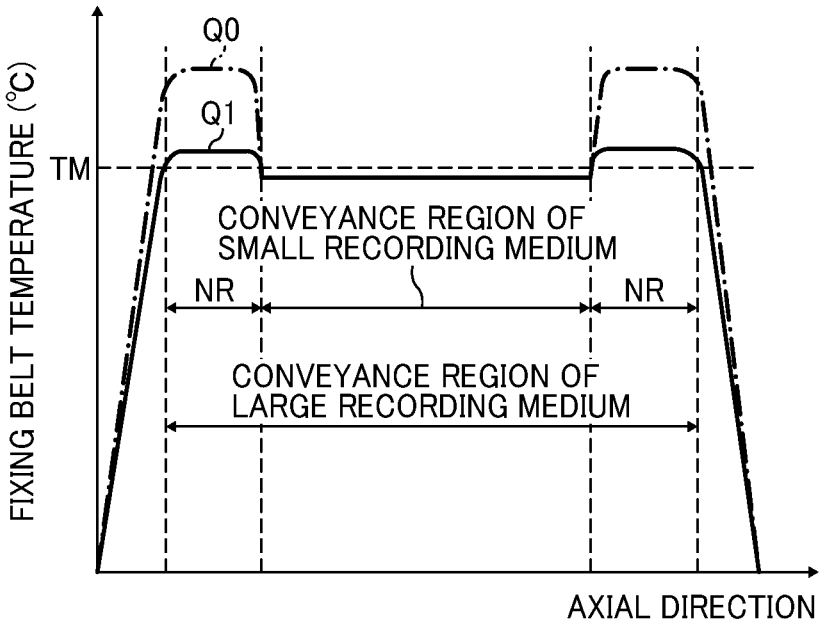
FIG. 7 is a graph illustrating a temperature distribution of the fixing belt shown in FIG. 4A in an axial direction thereof when small recording media are conveyed through a fixing nip continuously.

FIG. 7 is a graph illustrating a temperature distribution of the fixing belt 21 in the axial direction thereof when small recording media P are conveyed through the fixing nip N continuously. The graph shows the two lines: a line Q0, that is, the alternate-long-and-short-dashed line, indicating the temperature distribution of the fixing belt 21 with the first heat generation layer 21*a* made of general metal; and a line Q1, that is, the solid line, indicating the temperature distribution of the fixing belt 21 with the first heat generation layer 21*a* made of a magnetic shunt metal material. The line Q1 shows that, with the first heat generation layer 21*a* made of the magnetic shunt metal material, the temperature of the fixing belt 21 is suppressed to around a predetermined fixing temperature TM even in the non-conveyance regions NR thereon through which small recording media P are not conveyed.

Alternatively, the first heat generation layer 21*a* of the fixing belt 21 may be made of a non-magnetic metal material such as gold, silver, copper, aluminum, zinc, tin, lead, bismuth, beryllium, antimony, and/or an alloy of these. With the first heat generation layer 21*a* made of the above-described alternative material, even when the distance between the exciting coil unit 25 and the fixing belt 21 disposed opposite each other changes, an amount of magnetic flux generated by the exciting coil unit 25 and penetrating the fixing belt 21 does not change substantially, minimizing variation in heating of the fixing belt 21 in the axial direction thereof. Moreover, even when the fixing belt 21 is displaced or skewed in the axial direction thereof as it rotates in the rotation direction R1, it can be heated substantially uniformly in the axial direction thereof.

Preferably, the first heat generation layer 21*a* of the fixing belt 21 has a thickness smaller than a skin depth when an alternating electric current of a predetermined frequency is applied to the exciting coil 26 of the exciting coil unit 25. The "skin depth" defines a value obtained based on a resistivity and a magnetic permeability of the first heat generation layer 21*a* and a frequency of the alternating electric current that excites the first heat generation layer 21*a*, that is, a value in a range of from about 20 kHz to about 100 kHz of the frequency of the alternating electric current supplied from the alternating electric current power supply according to this example embodiment. Thus, with the first heat generation layer 21*a* having the thickness smaller than the skin depth as described above according to this example embodiment, the magnetic flux generated by the exciting coil unit 25 precisely reaches the second heat generation layer 23*d* of the heat generator 23.

A detailed description is now given of a configuration of the second heat generation layer 23*d* of the heat generator 23 depicted in FIG. 4B.

The second heat generation layer 23*d* is made of a magnetic shunt metal material having property changing from ferromagnetism to paramagnetism such as iron, nickel, silicone, boron, niobium, copper, zirconium, cobalt, and/or an alloy of these. With the second heat generation layer 23*d* made of the above-described material, when a Curie temperature of the second heat generation layer 23*d* is set to a temperature greater than the predetermined fixing temperature and not greater than the upper temperature limit of the fixing belt 21, the fixing belt 21 does not overheat. When the temperature of the second heat generation layer 23*d* exceeds the Curie temperature, the magnetic flux generated by the exciting coil unit 25 penetrates the second heat generation layer 23*d*. To address this circumstance, the magnetic flux shield made of a non-magnetic material may be disposed opposite the exciting coil unit 25 via the heat generator 23 and the fixing belt 21. Thus, the magnetic flux penetrating the second heat generation layer 23*d* of the heat generator 23 reaches the magnetic flux shield, which in turn generates an eddy current that offsets the penetrating magnetic flux.

Alternatively, the second heat generation layer 23*d* of the heat generator 23 may be made of a ferromagnetic metal material such as iron, nickel, and/or cobalt. With the second heat generation layer 23*d* made of the above-described material, the magnetic flux generated by the exciting coil unit 25 does not penetrate the second heat generation layer 23*d* of the heat generator 23, thus improving heating efficiency for heating the heat generator 23 by electromagnetic induction even without the magnetic flux shield.

According to this example embodiment described above, the heat generator 23 is constructed of a single layer, that is, the second heat generation layer 23*d*. Alternatively, the heat generator 23 may be constructed of multiple layers: an inner surface layer serving as a heat generation layer, which generates heat by electromagnetic induction, equivalent to the second heat generation layer 23*d*; an intermediate layer made of a high-thermal conductive material such as aluminum, iron, and/or stainless steel; and an outer surface layer serving as another heat generation layer, which generates heat by electromagnetic induction, equivalent to the second heat generation layer 23*d*, for example.

As shown in FIGS. 2, 3A, and 3B, the heat generator driver 42 rotates the heat generator 23 to change the position of the first heat generation portion 23A disposed opposite the exciting coil unit 25 precisely for fine adjustment, thus adjusting an amount of heat generated by the second heat generation layer 23*d* of the first heat generation portion 23A of the heat generator 23 by electromagnetic induction. The amount of heat generated by the second heat generation layer 23*d* of the heat generator 23 is adjusted according to controls described below based on the operative condition of the fixing device 20, thus attaining various advantages below.

For example, while the fixing device 20 or the image forming apparatus 1 depicted in FIG. 1 installed with the fixing device 20 is warmed up, the controller 60 controls the heat generator driver 42 to move the heat generator 23 to the second heating position shown in FIG. 3B where the second heat generation portion 23B is disposed opposite the exciting coil unit 25, thus causing the second heat generation layer 23*d* of the heat generator 23 to generate an increased amount of heat. Thus, even when the image forming apparatus 1 is cool in the morning after it has been powered off for a long time, the cool fixing belt 21 is heated to a desired fixing temperature quickly because it receives the increased amount of heat from the heat generator 23. By contrast, when a recording medium P bearing a toner image T is conveyed through the fixing nip N formed between the fixing belt 21 and the pressing roller 31, the controller 60 controls the heat generator driver 42 to move the heat generator 23 to the first heating position shown in FIG. 3A where the first heat generation portion 23A is disposed opposite the exciting coil unit 25, thus causing the second heat generation layer 23*d* of the heat generator 23 to generate a decreased amount of heat. Thus, the fixing belt 21, which is heated sufficiently during warm-up as described above, supplementarily receives the decreased amount of heat from the heat generator 23.

When the temperature sensor 40 detects that the temperature of the fixing belt 21 is lower than a predetermined temperature, the controller 60 controls the heat generator driver 42 to move the heat generator 23 to the second heating position shown in FIG. 3B where the second heat generation portion 23B is disposed opposite the exciting coil unit 25, thus causing the second heat generation layer 23*d* of the heat generator 23 to generate the increased amount of heat. By contrast, when the temperature sensor 40 detects that the temperature of the fixing belt 21 is equivalent to or higher than the predetermined temperature, the controller 60 controls the heat generator driver 42 to move the heat generator 23 to the first heating position shown in FIG. 3A where the first heat generation portion 23A is disposed opposite the exciting coil unit 25, thus causing the second heat generation layer 23*d* of the heat generator 23 to generate the decreased amount of heat. The control described above is also applicable when the plurality of recording media P is conveyed through the fixing nip N continuously.

Further, when a thin recording medium P having a thickness smaller than a predetermined thickness is conveyed through the fixing nip N, the controller 60 controls the heat generator driver 42 to move the heat generator 23 to the first heating position shown in FIG. 3A where the first heat generation portion 23A is disposed opposite the exciting coil unit 25, thus causing the second heat generation layer 23*d* of the heat generator 23 to generate the decreased amount of heat. Specifically, as the thin recording medium P is conveyed through the fixing nip N, it draws a decreased amount of heat from the fixing belt 21. Hence, the temperature of the fixing belt 21 is stabilized even if the decreased amount of heat is conducted from the heat generator 23 to the fixing belt 21.

The image forming apparatus 1 depicted in FIG. 1 is a monochrome image forming apparatus. Alternatively, the fixing device 20 according to this example embodiment is installable in a color image forming apparatus. In this case, if a monochrome print mode for forming a monochrome toner image T on a recording medium P is selected, the controller 60 controls the heat generator driver 42 to move the heat generator 23 to the first heating position shown in FIG. 3A where the first heat generation portion 23A is disposed opposite the exciting coil unit 25, thus causing the second heat generation layer 23*d* of the heat generator 23 to generate the decreased amount of heat. Specifically, in the monochrome print mode, the monochrome toner image T on the recording medium P draws less heat from the fixing belt 21 compared to in a color print mode for forming a color toner image T on the recording medium P. Accordingly, even if the decreased amount of heat is conducted from the heat generator 23 to the fixing belt 21, the temperature of the fixing belt 21 is stabilized.

As shown in FIGS. 5A and 5B, the heat generator 23 includes the two heat generation portions incorporating non-conductive portions having different sizes, that is, the first heat generation portion 23A incorporating the first slits 23*a*1 having an increased size and the second heat generation portion 23B incorporating the second slits 23*a*2 having a decreased size. Alternatively, the heat generator 23 may further include a third heat generation portion incorporating third slits having a size smaller than that of the second slits 23*a*2 of the second heat generation portion 23B or incorporating no slit. In this case, the controller 60 controls the heat generator driver 42 to move the third heat generation portion to a third heating position where the third heat generation portion is disposed opposite the exciting coil unit 25, thus causing the second heat generation layer 23*d* of the heat generator 23 to generate an amount of heat even smaller than that of the second heat generation portion 23B disposed at the second heating position shown in FIG. 3B.

Figure 8:
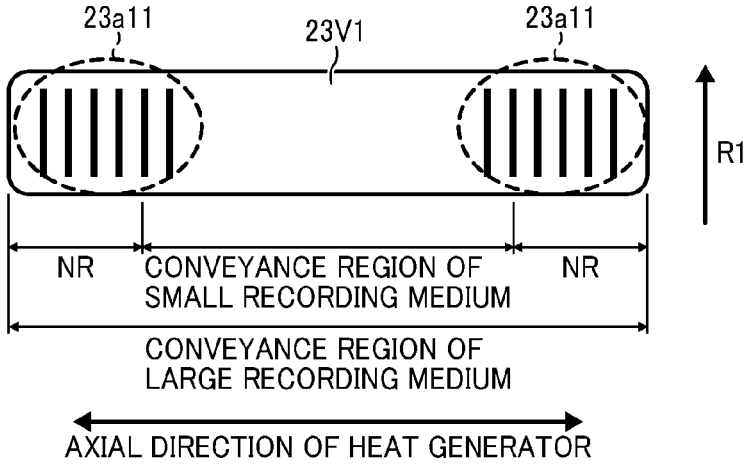
FIG. 8 is a top view of a heat generation portion incorporating slits as a first variation of the second heat generation portion shown in FIG. 5B.
Figure 9A:
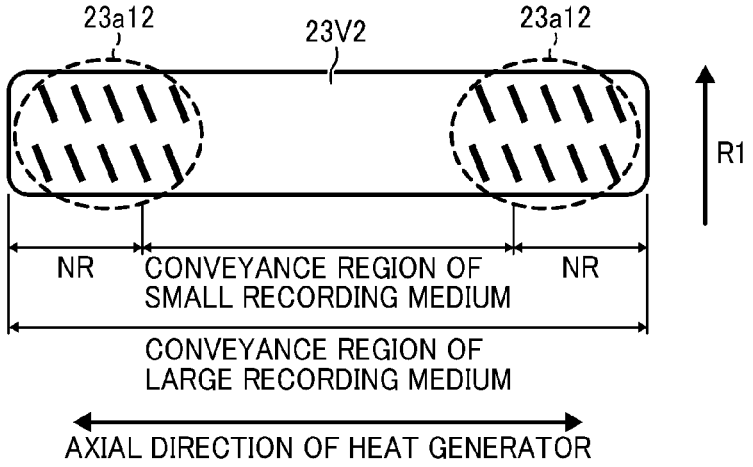
FIG. 9A is a top view of a heat generation portion incorporating slits as a second variation of the second heat generation portion shown in FIG. 5B.
Figure 9B:
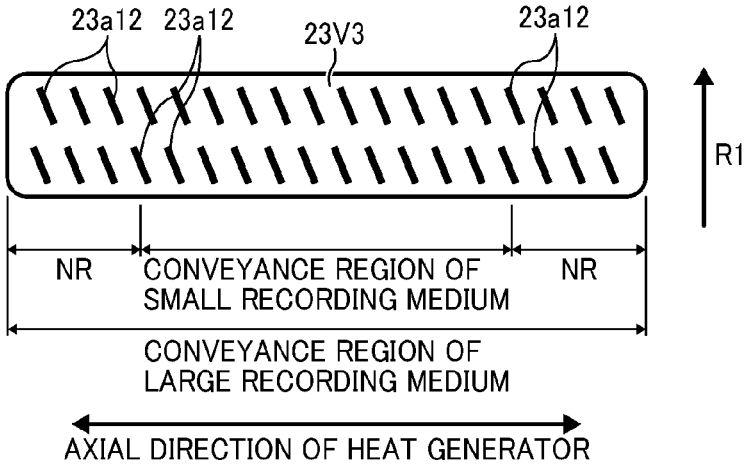
FIG. 9B is a top view of a heat generation portion incorporating slits as a third variation of the first heat generation portion shown in FIG. 5A.

Referring to FIGS. 8, 9A, and 9B, the following describes three variations of the first slits 23*a*1 and the second slits 23*a*2 described above with reference to FIGS. 5A and 5B.

Referring to FIG. 8, a detailed description is now given of a first variation of the first slits 23*a*1 and the second slits 23*a*2. FIG. 8 is a top view of a heat generation portion 23V1 incorporating slits 23*a*11 as the first variation. For example, the slits 23*a*11 (e.g., through-holes) serving as a non-conductive portion are produced at both lateral ends of the heat generation portion 23V1 in a longitudinal direction thereof parallel to the axial direction of the fixing belt 21 depicted in FIG. 2 disposed opposite the non-conveyance regions NR on the fixing belt 21 where a small recording medium P is not conveyed. The slits 23*a*11 extend in a direction orthogonal to a direction in which an eddy current is induced in the second heat generation layer 23*d* of the heat generator 23. That is, the slits 23*a*11 extend in parallel to the rotation direction R1 of the fixing belt 21.

The slits 23*a*11 extending in the direction orthogonal to the direction in which the eddy current is induced in the second heat generation layer 23*d* of the heat generator 23 prevent a magnetic flux from moving across the slits 23*a*11 in the longitudinal direction of the heat generation portion 23V1, thus preventing temperature decrease of the heat generation portion 23V1 at both lateral ends of the conveyance region of the small recording medium P in the longitudinal direction of the heat generation portion 23V1. The slits 23*a*11 are produced at both lateral ends of the heat generation portion 23V1 in the longitudinal direction thereof that are disposed opposite the non-conveyance regions NR on the fixing belt 21 where the small recording medium P is not conveyed. Accordingly, even if there is no recording medium P that slides over both lateral ends of the fixing belt 21 in the axial direction thereof and draws heat therefrom, both lateral ends of the fixing belt 21 do not overheat. That is, even after a plurality of small recording media P is conveyed through the fixing nip N continuously, that does not slide over both lateral ends of the fixing belt 21 in the axial direction thereof, both lateral ends of the fixing belt 21 do not overheat.

Referring to FIG. 9A, a detailed description is now given of a second variation of the first slits 23*a*1 and the second slits 23*a*2 depicted in FIGS. 5A and 5B.

FIG. 9A is a top view of a heat generation portion 23V2 incorporating slits 23*a*12 as the second variation. The slits 23*a*12 are produced at both lateral ends of the heat generation portion 23V2 in a longitudinal direction thereof parallel to the axial direction of the fixing belt 21, that are disposed opposite the non-conveyance regions NR on the fixing belt 21 where the small recording medium P is not conveyed. Unlike the slits 23*a*11 depicted in FIG. 8 that extend parallel to the rotation direction R1 of the fixing belt 21, the slits 23*a*12 extend diagonally to the rotation direction R1 of the fixing belt 21. The slits 23*a*12 extending diagonally to the rotation direction R1 of the fixing belt 21 prevent a magnetic flux from moving across the slits 23*a*12 in the longitudinal direction of the heat generation portion 23V2, thus preventing temperature decrease of the heat generation portion 23V2 at both lateral ends of the conveyance region of the small recording medium P in the longitudinal direction of the heat generation portion 23V2 and therefore attaining a uniform heat generation distribution in the longitudinal direction of the heat generation portion 23V2.

Referring to FIG. 9B, a detailed description is now given of a third variation of the first slits 23*a*1 and the second slits 23*a*2 depicted in FIGS. 5A and 5B.

FIG. 9B is a top view of a heat generation portion 23V3 incorporating the slits 23*a*12 as the third variation. The slits 23*a*12 are produced throughout the entire width of the heat generation portion 23V3 in a longitudinal direction thereof parallel to the axial direction of the fixing belt 21. The slits 23*a*12 extend diagonally to the rotation direction R1 of the fixing belt 21. The heat generation portion 23V3 generates a decreased amount of heat compared to a heat generation portion incorporating no slit. However, the heat generation portion 23V3 attains a uniform heat generation distribution in the longitudinal direction thereof that is improved further than that of the heat generation portion 23V2.

The following describes advantages of the fixing device 20.

As shown in FIGS. 2, 3A, and 3B, the heat generator driver 42 rotates the heat generator 23 in a state in which the heat generator 23 slides over the inner circumferential surface of the fixing belt 21, moving the non-conductive portion (e.g., the first slits 23*a*1 depicted in FIG. 5A, the second slits 23*a*2 depicted in FIG. 5B, the slits 23*a*11 depicted in FIG. 8, and the slits 23*a*12 depicted in FIGS. 9A and 9B) produced in the heat generator 23 with respect to the exciting coil unit 25 and thereby changing the amount of heat generated by the second heat generation layer 23*d* of the heat generator 23 and the heat generation distribution of the heat generator 23. Accordingly, the heat generator 23 improves heating efficiency for heating the fixing belt 21 by electromagnetic induction and thereby heats the fixing belt 21 quickly.

As shown in FIG. 2, the heat generator 23 is divided into two parts in the rotation direction of the fixing belt 21, that is, the first heat generation portion 23A and the second heat generation portion 23B. Alternatively, the heat generator 23 may be divided into three or more parts. In this case also, one of the three or more parts of the heat generator 23 is selectively rotated to an opposed position where it is disposed opposite the exciting coil unit 25 according to the operative condition of the fixing device 20, thus attaining the advantages described above. Further, the first heat generation portion 23A is isolated from the second heat generation portion 23B in the rotation direction R1 of the fixing belt 21.

Alternatively, the first heat generation portion 23A may be disposed closer to or in contact with the second heat generation portion 23B in the rotation direction R1 of the fixing belt 21. In this case also, one of the first heat generation portion 23A and the second heat generation portion 23B is selectively rotated to the opposed position where it is disposed opposite the exciting coil unit 25 according to the operative condition of the fixing device 20, thus attaining the advantages described above. Yet alternatively, the heat generator 23 may include three or more heat generation portions disposed closer to or in contact with each other in the rotation direction R1 of the fixing belt 21.

Figure 10:
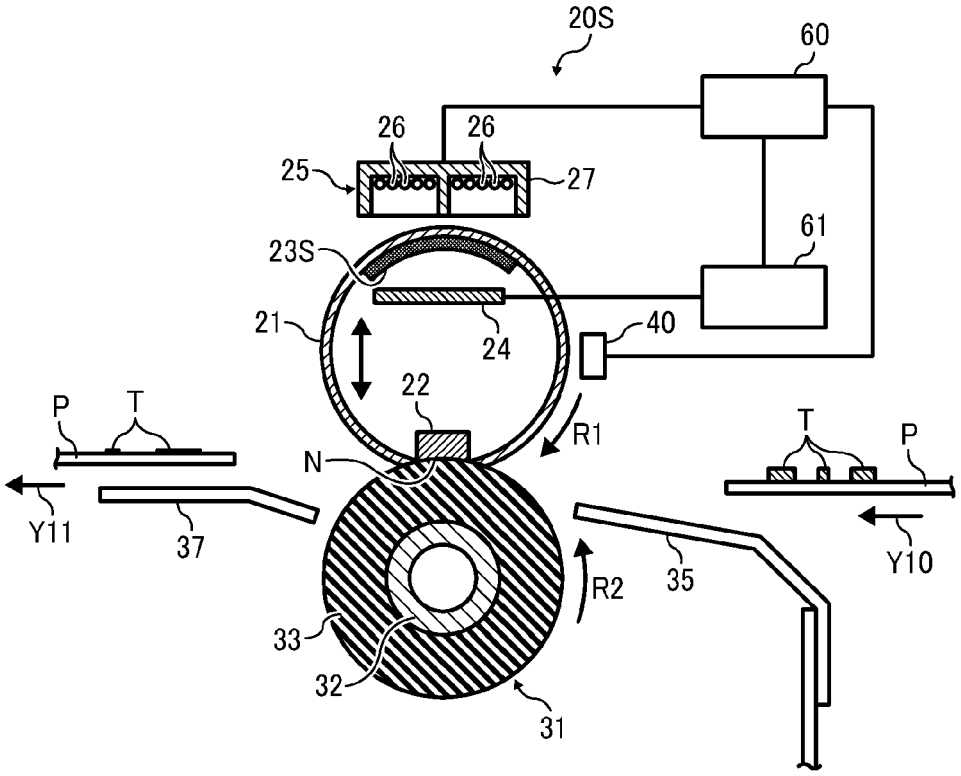
FIG. 10 is a vertical sectional view of a fixing device according to a second example embodiment.
Figure 11A:
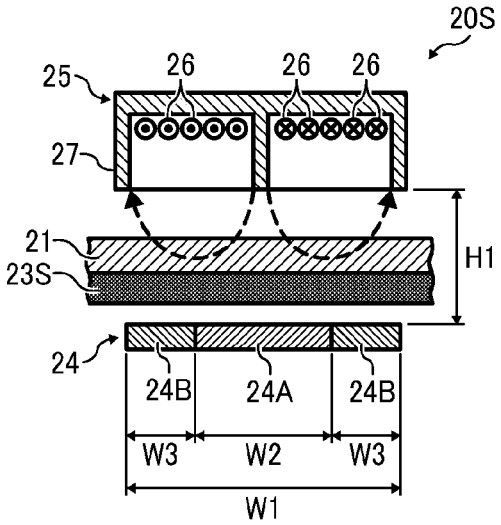
FIG. 11A is a partial vertical sectional view of the fixing device shown in FIG. 10 at a first heating position for heating a fixing belt incorporated therein.
Figure 11B:
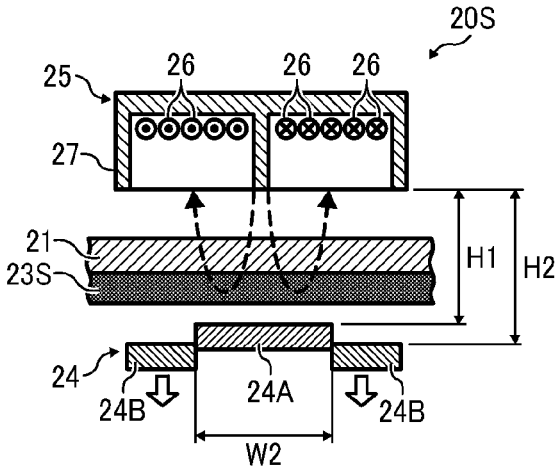
FIG. 11B is a partial vertical sectional view of the fixing device at a second heating position for heating the fixing belt shown in FIG. 11A.

Referring to FIGS. 10, 11A, and 11B, the following describes a configuration of a fixing device 20S according to a second example embodiment that is installable in the image forming apparatus 1 depicted in FIG. 1.

FIG. 10 is a vertical sectional view of the fixing device 20S. FIG. 11A is a partial vertical sectional view of the fixing device 20S at a first heating position for heating the fixing belt 21. FIG. 11B is a partial vertical sectional view of the fixing device 20S at a second heating position for heating the fixing belt 21.

A detailed description is now given of a construction of the fixing device 20S.

As shown in FIG. 10, the fixing device 20S includes the fixing belt 21 serving as a fixing rotary body formed into the loop and rotatable in the rotation direction R1; a nip formation pad 22 stationarily disposed inside the loop formed by the fixing belt 21; the pressing roller 31 serving as a pressing rotary body rotatable in the rotation direction R2 counter to the rotation direction R1 of the fixing belt 21 and pressed against the nip formation pad 22 via the fixing belt 21 to form the fixing nip N between the pressing roller 31 and the fixing belt 21; a heat generator 23S disposed inside the loop formed by the fixing belt 21; a ferromagnet 24, that is, a magnetic flux adjuster, disposed inside the loop formed by the fixing belt 21; the exciting coil unit 25 disposed outside the loop formed by the fixing belt 21; the temperature sensor 40 serving as a temperature detector disposed opposite the outer circumferential surface of the fixing belt 21; and the upstream guide plate 35 and the downstream guide plate 37 disposed outside the loop formed by the fixing belt 21.

A detailed description is now given of a construction of the fixing belt 21.

The fixing belt 21 has the construction described above with reference to FIG. 2 and FIG. 4A. However, unlike the fixing belt 21 depicted in FIG. 2 that slides over the heat generator 23, the inner circumferential surface of the fixing belt 21 installed in the fixing device 20S slides over the heat generator 23S and the nip formation pad 22.

The nip formation pad 22, the heat generator 23S, and the ferromagnet 24 are fixedly provided inside the loop formed by the fixing belt 21, thus facing the inner circumferential surface of the fixing belt 21. The exciting coil unit 25, that is, an induction heater, is disposed opposite a part of the outer circumferential surface of the fixing belt 21 with a gap provided therebetween. The inner circumferential surface of the fixing belt 21 is applied with a lubricant.

A detailed description is now given of a construction of the nip formation pad 22.

The nip formation pad 22 is stationarily disposed inside the loop formed by the fixing belt 21 in such a manner that the inner circumferential surface of the fixing belt 21 slides over the nip formation pad 22. The nip formation pad 22 presses against the pressing roller 31 via the fixing belt 21 to form the fixing nip N between the fixing belt 21 and the pressing roller 31 through which a recording medium P bearing a toner image T is conveyed. Each lateral end of the nip formation pad 22 in a longitudinal direction thereof is mounted on a side plate of the fixing device 20S. The nip formation pad 22 is made of a material having a rigidity great enough to endure pressure from the pressing roller 31, thus preventing substantial bending of the nip formation pad 22. A concave opposed face of the nip formation pad 22 over which the fixing belt 21 slides corresponds to a curvature of the pressing roller 31 and is disposed opposite the pressing roller 31 via the fixing belt 21. Accordingly, the recording medium P is discharged from the fixing nip N as it is curved along an outer circumferential surface of the pressing roller 31. Consequently, the recording medium P does not adhere to the fixing belt 21 after the fixing process, and therefore separates from the fixing belt 21. Alternatively, the nip formation pad 22 may have a planar opposed face disposed opposite the pressing roller 31 via the fixing belt 21. Accordingly, the fixing nip N is substantially parallel to an image side of the recording medium P to enhance fixing property, that is, to adhere the recording medium P to the fixing belt 21 more precisely. Further, the fixing belt 21 has an increased curvature at an exit of the fixing nip N that facilitates separation of the recording medium P discharged from the fixing nip N from the fixing belt 21.

Figure 12:
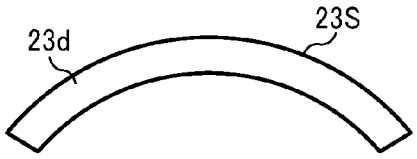
FIG. 12 is a vertical sectional view of a heat generator incorporated in the fixing device shown in FIG. 10.

Referring to FIGS. 10 and 12, a detailed description is now given of a construction of the heat generator 23S.

FIG. 12 is a vertical sectional view of the heat generator 23S. The heat generator 23S is disposed opposite the exciting coil unit 25 via the fixing belt 21 and in contact with the inner circumferential surface of the fixing belt 21. Each lateral end of the heat generator 23S in a longitudinal direction thereof is mounted on the side plate of the fixing device 20S. As shown in FIG. 12, the heat generator 23S is constructed of the second heat generation layer 23*d*, made of a conductive material, heated by the exciting coil unit 25 by electromagnetic induction. For example, the heat generator 23S is heated by an alternating magnetic field generated by the exciting coil unit 25, thus heating the fixing belt 21. That is, the heat generator 23S is heated by electromagnetic induction directly by the exciting coil unit 25 and the fixing belt 21 is heated by the exciting coil unit 25 indirectly via the heat generator 23S. Since the fixing belt 21 is also constructed of the first heat generation layer 21*a* as shown in FIG. 4A, the first heat generation layer 21*a* of the fixing belt 21 is also heated by electromagnetic induction directly by the alternating magnetic field generated by the exciting coil unit 25. That is, the fixing belt 21 is heated by electromagnetic induction directly by the exciting coil unit 25 and indirectly via the heat generator 23S heated by electromagnetic induction by the exciting coil unit 25, improving heating efficiency of the fixing belt 21.

Hence, as the recording medium P bearing the toner image T is conveyed through the fixing nip N, heat is conducted from the outer circumferential surface of the fixing belt 21 to the recording medium P. The exciting coil unit 25, the temperature sensor 40, the upstream guide plate 35, and the downstream guide plate 37 installed in the fixing device 20S are identical to those installed in the fixing device 20 depicted in FIG. 2 described above.

Referring to FIG. 10, a detailed description is now given of a construction of the ferromagnet 24.

The ferromagnet 24 is a magnetic flux adjuster or an internal core disposed opposite the exciting coil unit 25 via the heat generator 23S and the fixing belt 21. The ferromagnet 24 is made of a ferromagnetic material that adjusts a magnetic flux and has a relative permeability of about 2,500, such as ferrite. A driver 61 (e.g., a motor) operatively connected to the controller 60 moves the ferromagnet 24 with respect to the exciting coil unit 25. As the ferromagnet 24 is moved by the driver 61 with respect to the exciting coil unit 25, the ferromagnet 24 changes the density of a magnetic flux applied to the first heat generation layer 21*a* of the fixing belt 21, a detailed description of which is deferred.

A detailed description is now given of a construction of the pressing roller 31.

The pressing roller 31 installed in the fixing device 20S is identical to that installed in the fixing device 20 depicted in FIG. 2 described above with an exception. That is, the pressing roller 31 is pressed against the nip formation pad 22 via the fixing belt 21 to form the fixing nip N between the pressing roller 31 and the fixing belt 21.

Since the pressing roller 31 includes the elastic layer 33 made of a sponge material such as silicone rubber foam, the pressing roller 31 exerts decreased pressure to the nip formation pad 22 via the fixing belt 21 at the fixing nip N, thus decreasing bending of the nip formation pad 22.

An operation of the fixing device 20S to fix a toner image T on a recording medium P is identical to that of the fixing device 20 described above with reference to FIGS. 1 and 2 with an exception. That is, the fixing belt 21 heated by the exciting coil unit 25 and the heat generator 23S heats the recording medium P and at the same time the fixing belt 21 pressed against the pressing roller 31 by the nip formation pad 22 and the pressing roller 31 together exert pressure to the recording medium P, thus fixing the toner image T on the recording medium P.

Referring to FIGS. 10 to 13B, the following describes the configuration and operation of the fixing device 20S according to the second example embodiment in detail.

As shown in FIG. 10, the controller 60 controls the driver 61 to move the ferromagnet 24 with respect to the exciting coil unit 25, thus changing the density of a magnetic flux applied to the first heat generation layer 21*a* of the fixing belt 21.

As shown in FIGS. 11A and 11B, the ferromagnet 24 is divided into a plurality of parts in the rotation direction R1 of the fixing belt 21: a single first ferromagnetic portion 24A and two second ferromagnetic portions 24B. For example, the first ferromagnetic portion 24A is disposed opposite a center of the exciting coil unit 25 in the rotation direction R1 of the fixing belt 21, which is defined by a span W2. Conversely, the second ferromagnetic portions 24B are contiguous to and sandwich the first ferromagnetic portion 24A in the rotation direction R1 of the fixing belt 21. Each second ferromagnetic portion 24B is disposed opposite each lateral end of the exciting coil unit 25 in the rotation direction R1 of the fixing belt 21, which is defined by a span W3. Thus, the first ferromagnetic portion 24A and the contiguous second ferromagnetic portions 24B are disposed opposite the exciting coil unit 25 in the entire span thereof in the rotation direction R1 of the fixing belt 21, which is defined by a span W1. The first ferromagnetic portion 24A and the second ferromagnetic portions 24B are made of an identical material, that is, a ferromagnetic material such as ferrite. The driver 61 depicted in FIG. 10 moves the second ferromagnetic portions 24B to change a distance between each of the second ferromagnetic portions 24B and the exciting coil unit 25 disposed opposite the second ferromagnetic portions 24B. For example, the first ferromagnetic portion 24A is mounted on the side plate of the fixing device 20S in a state in which the first ferromagnetic portion 24A is disposed opposite the exciting coil unit 25 via the heat generator 23S and the fixing belt 21 with a first distance H1 provided between the first ferromagnetic portion 24A and the exciting coil unit 25.

By contrast, the second ferromagnetic portions 24B are disposed opposite the exciting coil unit 25 via the heat generator 23S and the fixing belt 21 with the first distance H1 or a second distance H2 provided between the second ferromagnetic portions 24B and the exciting coil unit 25. Specifically, each second ferromagnetic portion 24B is movable and slidable in a groove produced in the side plate of the fixing device 20S. For example, the groove is an elongate through-hole extending in a vertical direction in FIG. 10 perpendicular to the directions Y10 and Y11 in which the recording medium P is conveyed. Hence, the controller 60 controls the driver 61 to move the second ferromagnetic portions 24B in the vertical direction in FIG. 10, thus changing the distance between the second ferromagnetic portions 24B and the exciting coil unit 25 between the first distance H1 and the second distance H2.

Figure 13A:
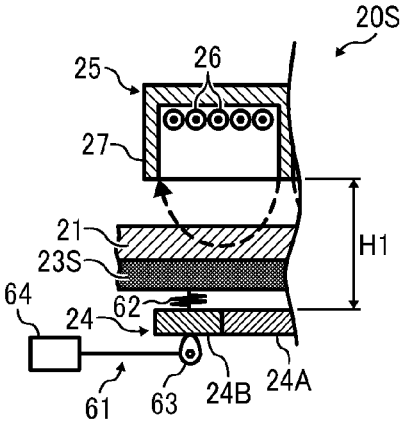
FIG. 13A is a vertical sectional view of a driver and a ferromagnet incorporated in the fixing device shown in FIG. 10 in a state in which the driver moves a second ferromagnetic portion of the ferromagnet to the first heating position.
Figure 13B:
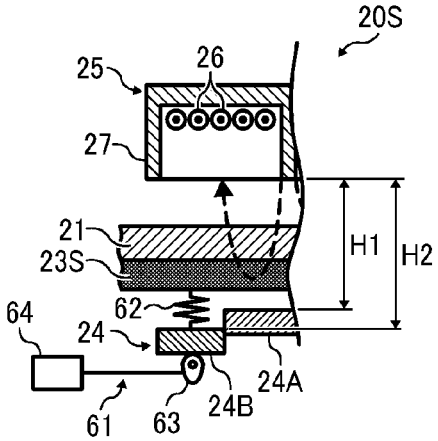
FIG. 13B is a vertical sectional view of the driver and the ferromagnet shown in FIG. 13A in a state in which the driver moves the second ferromagnetic portion of the ferromagnet to the second heating position.

Referring to FIGS. 13A and 13B, a detailed description is now given of a construction of the driver 61 that moves the second ferromagnetic portions 24B with respect to the exciting coil unit 25.

FIG. 13A is a vertical sectional view of the driver 61 in a state in which the driver 61 moves the second ferromagnetic portion 24B to the first heating position where the first distance H1 is provided between the second ferromagnetic portion 24B and the exciting coil unit 25. FIG. 13B is a vertical sectional view of the driver 61 in a state in which the driver 61 moves the second ferromagnetic portion 24B to the second heating position where the second distance H2 is provided between the second ferromagnetic portion 24B and the exciting coil unit 25. The driver 61 is constructed of a tension spring 62 anchored to an upper face of the second ferromagnetic portion 24B and a lower face of the heat generator 23S, a cam 63 contacting a lower face of the second ferromagnetic portion 24B, and a motor 64 connected to the cam 63. The tension spring 62 exerts a bias to the second ferromagnetic portion 24B downward in FIG. 13B that separates it away from the exciting coil unit 25. As the motor 64 rotates the cam 63, the cam 63 moves the second ferromagnetic portion 24B against the bias exerted by the tension spring 62 between the first heating position shown in FIG. 13A and the second heating position shown in FIG. 13B. Alternatively, the tension spring 62 may be anchored to a stationary member other than the heat generator 23S such as the exciting coil unit 25 and a frame of the fixing device 20S.

With the construction of the ferromagnet 24 and the driver 61 described above, as the controller 60 controls the driver 61 to move the ferromagnet 24 with respect to the exciting coil unit 25, the ferromagnet 24 moves between the first heating position shown in FIG. 11A and the second heating position shown in FIG. 11B, thus changing the density of a magnetic flux applied from the exciting coil unit 25 to the first heat generation layer 21*a* of the fixing belt 21. For example, at the first heating position shown in FIG. 11A, the exciting coil unit 25 heats the first heat generation layer 21*a* of the fixing belt 21 only by electromagnetic induction, thus heating the fixing belt 21 directly. Conversely, at the second heating position shown in FIG. 11B, the exciting coil unit 25 heats both the first heat generation layer 21*a* of the fixing belt 21 and the second heat generation layer 23*d* of the heat generator 23S by electromagnetic induction, thus heating the fixing belt 21 directly and at the same time heating the fixing belt 21 indirectly via the heat generator 23S. Specifically, the controller 60 controls the driver 61 to move the second ferromagnetic portions 24B of the ferromagnet 24 with respect to the exciting coil unit 25 between the first heating position shown in FIG. 11A and the second heating position shown in FIG. 11B. At the first heating position shown in FIG. 11A, the second ferromagnetic portions 24B are spaced apart from the exciting coil unit 25 with the first distance H1 therebetween. Conversely, at the second heating position shown in FIG. 11B, the second ferromagnetic portions 24B are spaced apart from the exciting coil unit 25 with the second distance H2 greater than the first distance H1 therebetween. Thus, the density of a magnetic flux applied from the exciting coil unit 25 to the first heat generation layer 21*a* of the fixing belt 21 is changed.

As shown in FIG. 11A, when the first ferromagnetic portion 24A and each second ferromagnetic portion 24B are spaced apart from the exciting coil unit 25 with the relatively small, first distance H1 therebetween at the first heating position, a magnetic flux generated from the exciting coil unit 25 is applied to the fixing belt 21 throughout substantially the entire span W1 corresponding to the combined span of the first ferromagnetic portion 24A and the second ferromagnetic portions 24B in the rotation direction R1 of the fixing belt 21. Accordingly, the density of the magnetic flux applied to the first heat generation layer 21*a* of the fixing belt 21 is small. For example, the magnetic flux generated by the exciting coil unit 25, indicated by the dotted arrow in FIG. 11A, reaches the first heat generation layer 21*a* of the fixing belt 21 only and does not reach the second heat generation layer 23*d* of the heat generator 23S, thus heating the first heat generation layer 21*a* of the fixing belt 21 only by electromagnetic induction in a first heating state. Since the magnetic flux from the exciting coil unit 25 concentrates in the first heat generation layer 21*a* of the fixing belt 21 only, the fixing belt 21 is heated quickly. Although heat is conducted from the fixing belt 21 to the heat generator 23S in the first heating state, since the heat generator 23S having a decreased thermal capacity contacts the fixing belt 21 in a limited area, that is, a part of the fixing belt 21 in a circumferential direction thereof, not the entire area thereof, the heat generator 23S does not degrade heating efficiency for heating the fixing belt 21 substantially.

Conversely, as shown in FIG. 11B, when the first ferromagnetic portion 24A is spaced apart from the exciting coil unit 25 with the first distance H1 therebetween and each second ferromagnetic portion 24B is spaced apart from the exciting coil unit 25 with the second distance H2 greater than the first distance H1 therebetween at the second heating position, a magnetic flux from the exciting coil unit 25 is applied to the fixing belt 21 in the span W2 smaller than the span W1 where only the first ferromagnetic portion 24A is spaced apart from the exciting coil unit 25 with the smaller first distance H1. Accordingly, the density of the magnetic flux applied to the first heat generation layer 21*a* of the fixing belt 21 is great. For example, the magnetic flux generated by the exciting coil unit 25, indicated by the dotted arrow in FIG. 11B, penetrates the first heat generation layer 21*a* of the fixing belt 21 and reaches the second heat generation layer 23*d* of the heat generator 23S, thus heating the second heat generation layer 23*d* of the heat generator 23S as well as the first heat generation layer 21*a* of the fixing belt 21 by electromagnetic induction in a second heating state. Since the magnetic flux from the exciting coil unit 25 disperses to the first heat generation layer 21*a* of the fixing belt 21 and the second heat generation layer 23*d* of the heat generator 23S, heat is conducted from the heat generator 23S to the fixing belt 21 to offset temperature decrease of the fixing belt 21.

Both in the first heating state and in the second heating state, the exciting coil unit 25 generates the identical magnetic field. The density of the magnetic flux applied to the first heat generation layer 21*a* of the fixing belt 21 in the second heating state is greater than that in the first heating state by about a differential between the spans W1 and W2. That is, the density of the magnetic flux applied from the exciting coil unit 25 to the first heat generation layer 21*a* of the fixing belt 21 is inversely proportional to the span of the ferromagnet 24 where it is spaced apart from the exciting coil unit 25 with the smaller first distance H1 therebetween.

The density of the magnetic flux applied to the first heat generation layer 21*a* of the fixing belt 21 determines the region, that is, the skin depth, of the first heat generation layer 21*a* where the magnetic flux is applied. It is because the skin depth is proportional to the resistivity of the first heat generation layer 21*a* and inversely proportional to the magnetic permeability of the first heat generation layer 21*a* and the frequency of the alternating electric current that excites the first heat generation layer 21*a*. That is, since the density of the magnetic flux applied to the first heat generation layer 21*a* is inversely proportional to the magnetic permeability of the first heat generation layer 21*a* that changes according to the position of the second ferromagnetic portions 24B of the ferromagnet 24 disposed opposite the exciting coil unit 25, the skin depth is proportional to the density of the magnetic flux applied to the first heat generation layer 21*a*. Thus, the fixing device 20S is configured to switch the position of the second ferromagnetic portions 24B of the ferromagnet 24 between the first heating position shown in FIG. 11A where the decreased density of the magnetic flux heats the fixing belt 21 quickly and the second heating position shown in FIG. 11B where the increased density of the magnetic flux causes the heat generator 23S to heat the fixing belt 21 supplementarily. Accordingly, the fixing belt 21 is heated properly based on its condition, that is, the temperature of the fixing belt 21 detected by the temperature sensor 40. Consequently, the exciting coil unit 25 heats the fixing belt 21 by electromagnetic induction with improved heating efficiency, shortening the time required to heat the fixing belt 21 to the predetermined fixing temperature.

For example, while the fixing device 20S or the image forming apparatus 1 depicted in FIG. 1 installed with the fixing device 20S is warmed up, the controller 60 controls the driver 61 to move the ferromagnet 24 to the first heating position shown in FIG. 11A where the second ferromagnetic portions 24B are spaced apart from the exciting coil unit 25 with the first distance H1 therebetween. Conversely, while recording media P are conveyed through the fixing nip N continuously, the controller 60 controls the driver 61 to move the ferromagnet 24 to the second heating position shown in FIG. 11B where the second ferromagnetic portions 24B are spaced apart from the exciting coil unit 25 with the second distance H2 therebetween. Thus, even when the image forming apparatus 1 is cool in the morning after it has been powered off for a long time, the fixing belt 21 is heated to a desired fixing temperature quickly by moving the second ferromagnetic portions 24B to the first heating position shown in FIG. 11A because the magnetic flux generated by the exciting coil unit 25 is concentrated on the first heat generation layer 21*a* of the fixing belt 21 only. Conversely, when recording media P are conveyed through the fixing nip N continuously, they draw heat from the fixing belt 21 gradually, thus decreasing the temperature of the fixing belt 21. To address this circumstance, heat is conducted from the heat generator 23S to the fixing belt 21, offsetting decrease of the temperature of the fixing belt 21 and therefore minimizing formation of a faulty fixed toner image due to the decreased temperature of the fixing belt 21.

When the second ferromagnetic portions 24B are at the first heating position shown in FIG. 11A, the density of the magnetic flux applied to the first heat generation layer 21*a* of the fixing belt 21 is smaller than the saturation magnetic flux density of the first heat generation layer 21*a*. Conversely, when the second ferromagnetic portions 24B are at the second heating position shown in FIG. 11B, the density of the magnetic flux applied to the first heat generation layer 21*a* of the fixing belt 21 is greater than the saturation magnetic flux density of the first heat generation layer 21*a*. As shown in FIG. 6, as the size of the magnetic field H increases, the magnetic flux density B also increases. However, when the magnetic field H has a predetermined size, the magnetic flux density B is saturated at the saturation magnetic flux density C. The controller 60 depicted in FIG. 10 controls the driver 61 to move the second ferromagnetic portions 24B of the ferromagnet 24 to the first heating position where the second ferromagnetic portions 24B are spaced apart from the exciting coil unit 25 with the first distance H1 therebetween, rendering the exciting coil unit 25 to apply a magnetic flux of the magnetic flux density B1 smaller than the saturation magnetic flux density C. Accordingly, the magnetic flux generated by the exciting coil unit 25 reaches the first heat generation layer 21*a* of the fixing belt 21 but does not penetrate it in the first heating state shown in FIG. 11A. Conversely, the controller 60 controls the driver 61 to move the second ferromagnetic portions 24B of the ferromagnet 24 to the second heating position where the second ferromagnetic portions 24B are spaced apart from the exciting coil unit 25 with the second distance H2 therebetween, rendering the exciting coil unit 25 to apply a magnetic flux of the magnetic flux density B2 greater than the saturation magnetic flux density C. Accordingly, the magnetic flux generated by the exciting coil unit 25 penetrates the first heat generation layer 21*a* of the fixing belt 21 and reaches the second heat generation layer 23*d* of the heat generator 23S in the second heating state shown in FIG. 11B.

Similar to the first heat generation layer 21*a* of the fixing belt 21 installed in the fixing device 20 depicted in FIG. 2, the first heat generation layer 21*a* of the fixing belt 21 installed in the fixing device 20S is made of the materials described above with reference to FIG. 7.

Further, similar to the first heat generation layer 21*a* of the fixing belt 21 installed in the fixing device 20 depicted in FIG. 2, the first heat generation layer 21*a* of the fixing belt 21 installed in the fixing device 20S has the thickness described above with reference to FIG. 7. For example, the first heat generation layer 21*a* of the fixing belt 21 has the thickness smaller than the skin depth. Thus, the magnetic flux generated by the exciting coil unit 25 precisely reaches the second heat generation layer 23*d* of the heat generator 23S when the second ferromagnetic portions 24B are at the second heating position shown in FIG. 11B.

Similar to the second heat generation layer 23*d* of the heat generator 23 installed in the fixing device 20 depicted in FIG. 2, the second heat generation layer 23*d* of the heat generator 23S installed in the fixing device 20S is made of the materials described above.

Alternatively, the second heat generation layer 23*d* of the heat generator 23S may be made of a ferromagnetic metal material such as iron, nickel, and/or cobalt. Thus, the magnetic flux generated by the exciting coil unit 25 does not penetrate the second heat generation layer 23*d* of the heat generator 23S even when the second ferromagnetic portions 24B are at the second heating position shown in FIG. 11B.

Further, similar to the second heat generation layer 23*d* of the heat generator 23 installed in the fixing device 20 depicted in FIG. 2, the second heat generation layer 23*d* of the heat generator 23S installed in the fixing device 20S is constructed of the single layer, that is, the second heat generation layer 23*d*, or the multiple layers including the second heat generation layer 23*d* as described above.

Figure 14A:
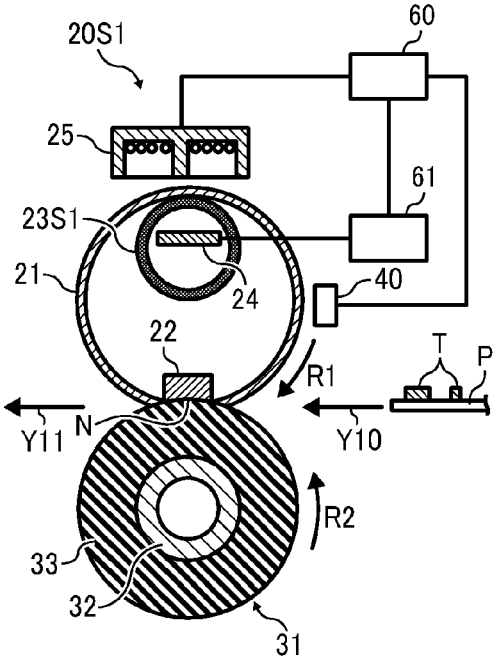
FIG. 14A is a vertical sectional view of a fixing device incorporating a heat generator as a first variation of the heat generator shown in FIG. 12.
Figure 14B:
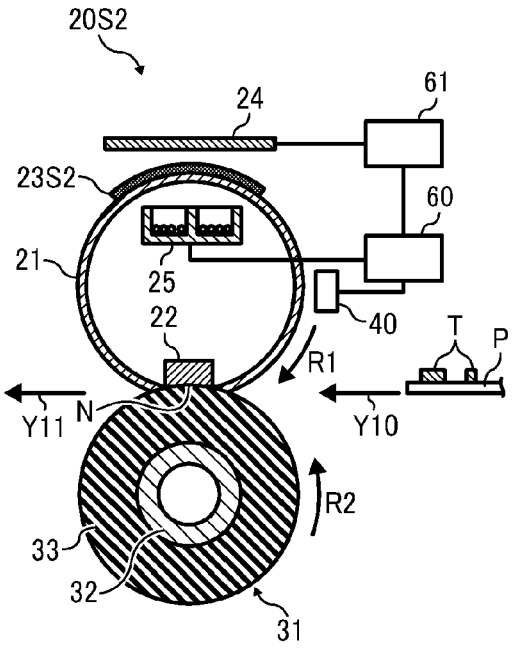
FIG. 14B is a vertical sectional view of a fixing device incorporating a heat generator as a second variation of the heat generator shown in FIG. 12.

Referring to FIGS. 14A and 14B, the following describes variations of the heat generator 23S depicted in FIG. 10.

FIG. 14A is a vertical sectional view of a fixing device 20S1 incorporating a heat generator 23S1 as a first variation of the heat generator 23S. As shown in FIG. 14A, unlike the semicylindrical heat generator 23S depicted in FIG. 10, the heat generator 23S1 is a cylinder. FIG. 14B is a vertical sectional view of a fixing device 20S2 incorporating a heat generator 23S2 as a second variation of the heat generator 23S. As shown in FIG. 14B, unlike the fixing device 20S depicted in FIG. 10 in which the heat generator 23S contacts the inner circumferential surface of the fixing belt 21 and the exciting coil unit 25 is disposed opposite the outer circumferential surface of the fixing belt 21, the fixing device 20S2 incorporates the heat generator 23S2 in contact with the outer circumferential surface of the fixing belt 21 and the exciting coil unit 25 disposed opposite the inner circumferential surface of the fixing belt 21. Similar to the fixing device 20S depicted in FIG. 10, the fixing devices 20S1 and 20S2 incorporate the controller 60 that controls the driver 61 to move the second ferromagnetic portions 24B of the ferromagnet 24 between the first heating position shown in FIG. 11A and the second heating position shown in FIG. 11B, changing the density of a magnetic flux applied from the exciting coil unit 25 to the first heat generation layer 21*a* of the fixing belt 21 and thus attaining the advantages of the fixing device 20S described above. Alternatively, the heat generators 23S1 and 23S2 may move or rotate as described below with reference to FIGS. 15 to 16C.

With the configuration of the fixing devices 20S, 20S1, and 20S2 described above, as the controller 60 controls the driver 61 to move the second ferromagnetic portions 24B of the ferromagnet 24 with respect to the exciting coil unit 25, the second ferromagnetic portions 24B of the ferromagnet 24 move between the first heating position shown in FIG. 11A and the second heating position shown in FIG. 11B, thus changing the density of a magnetic flux applied from the exciting coil unit 25 to the first heat generation layer 21*a* of the fixing belt 21. For example, at the first heating position shown in FIG. 11A, the exciting coil unit 25 heats the first heat generation layer 21*a* of the fixing belt 21 only by electromagnetic induction, thus heating the fixing belt 21 directly. Conversely, at the second heating position shown in FIG. 11B, the exciting coil unit 25 heats both the first heat generation layer 21*a* of the fixing belt 21 and the second heat generation layer 23*d* of the heat generator 23S, 23S1, or 23S2 by electromagnetic induction, thus heating the fixing belt 21 directly and at the same time heating the fixing belt 21 indirectly via the heat generator 23S, 23S1, or 23S2. Accordingly, the heat generator 23S, 23S1, or 23S2 improves heating efficiency for heating the fixing belt 21 by electromagnetic induction and thereby heats the fixing belt 21 quickly.

Referring to FIGS. 15 to 24, the following describes a configuration of a fixing device 20T according to a third example embodiment.

Figure 15:
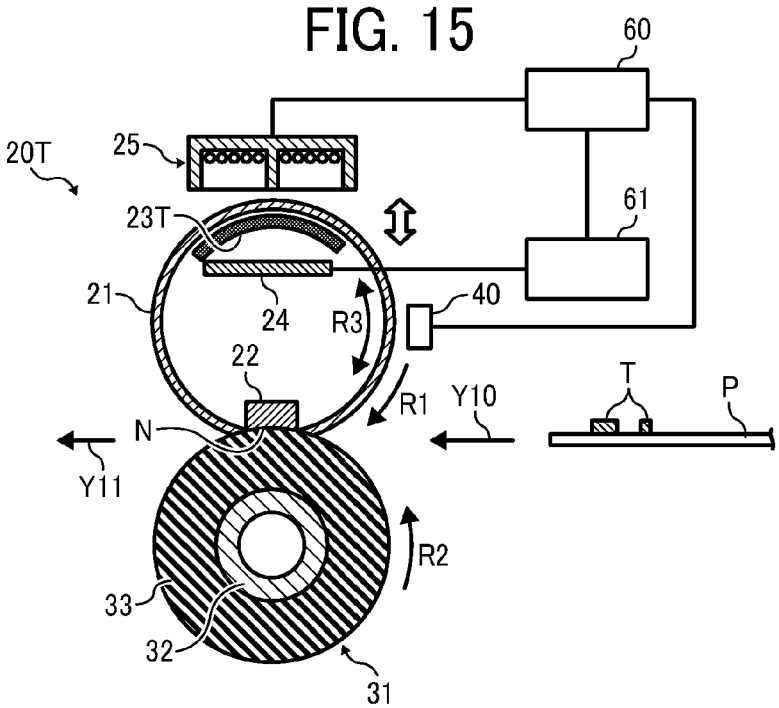
FIG. 15 is a vertical sectional view of a fixing device according to a third example embodiment.
Figure 16A:
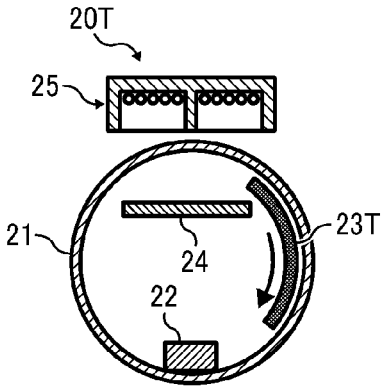
FIG. 16A is a partial vertical sectional view of the fixing device shown in FIG. 15 illustrating a heat generator separating from an exciting coil unit incorporated in the fixing device.
Figure 16B:
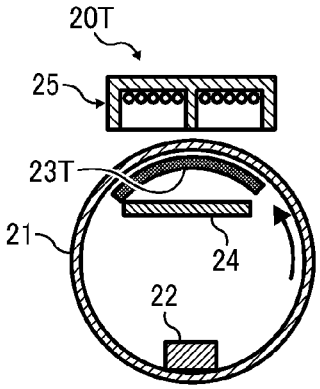
FIG. 16B is a partial vertical sectional view of the fixing device shown in FIG. 15 illustrating the heat generator disposed opposite the exciting coil unit and isolated from a fixing belt incorporated in the fixing device.
Figure 16C:
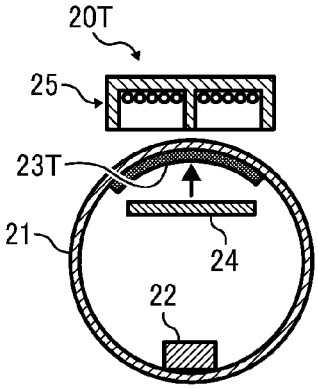
FIG. 16C is a partial vertical sectional view of the fixing device shown in FIG. 15 illustrating the heat generator disposed opposite the exciting coil unit and in contact with the fixing belt incorporated in the fixing device.
Figure 17:
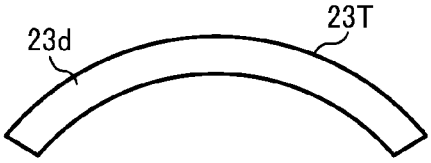
FIG. 17 is a vertical sectional view of the heat generator shown in FIG. 16C.
Figure 18:
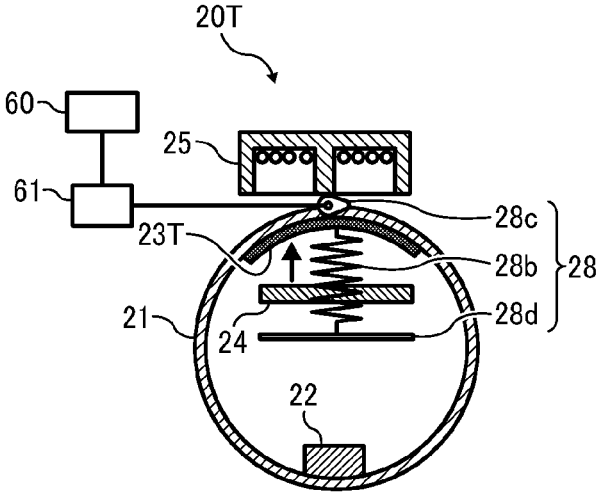
FIG. 18 is a partial vertical sectional view of the fixing device shown in FIG. 15 illustrating a separator incorporated therein.
Figure 19:
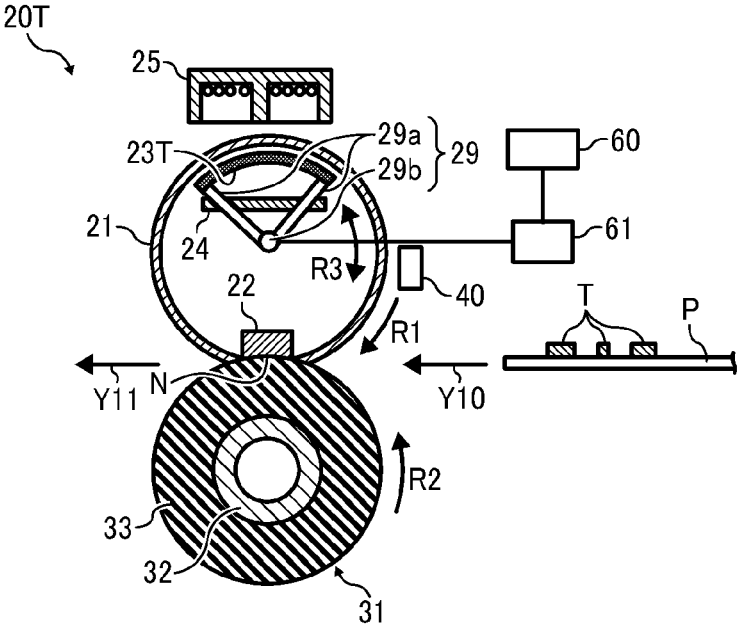
FIG. 19 is a partial vertical sectional view of the fixing device shown in FIG. 15 illustrating a rotating assembly incorporated therein.

FIG. 15 is a vertical sectional view of the fixing device 20T incorporating a heat generator 23T. FIG. 16A is a partial vertical sectional view of the fixing device 20T illustrating the heat generator 23T isolated from the exciting coil unit 25. FIG. 16B is a partial vertical sectional view of the fixing device 20T illustrating the heat generator 23T disposed opposite the exciting coil unit 25 and isolated from the fixing belt 21. FIG. 16C is a partial vertical sectional view of the fixing device 20T illustrating the heat generator 23T disposed opposite the exciting coil unit 25 and in contact with the fixing belt 21. FIG. 17 is a vertical sectional view of the heat generator 23T. FIG. 18 is a partial vertical sectional view of the fixing device 20T illustrating a separator 28. FIG. 19 is a partial vertical sectional view of the fixing device 20T illustrating a rotating assembly 29. Unlike the heat generator 23S of the fixing device 20S depicted in FIG. 10 that is stationarily disposed inside the loop formed by the fixing belt 21 and in contact with the fixing belt 21, the heat generator 23T of the fixing device 20T is separatable from the fixing belt 21.

As shown in FIG. 15, like the fixing device 20S depicted in FIG. 10, the fixing device 20T includes the endless fixing belt 21 serving as a fixing rotary body rotatable in the rotation direction R1; the nip formation pad 22 stationarily disposed inside the loop formed by the fixing belt 21; the pressing roller 31 serving as a pressing rotary body rotatable in the rotation direction R2 counter to the rotation direction R1 of the fixing belt 21 and pressed against the nip formation pad 22 via the fixing belt 21 to form the fixing nip N between the pressing roller 31 and the fixing belt 21; the heat generator 23T disposed inside the loop formed by the fixing belt 21; the ferromagnet 24, that is, a magnetic flux adjuster, disposed inside the loop formed by the fixing belt 21; the exciting coil unit 25 (e.g., an induction heater) disposed outside the loop formed by the fixing belt 21; and the temperature sensor 40 serving as a temperature detector disposed opposite the outer circumferential surface of the fixing belt 21. Similar to the fixing device 20S depicted in FIG. 10, the fixing device 20T incorporates the ferromagnet 24 divided into the first ferromagnetic portion 24A and the second ferromagnetic portions 24B contiguous to and sandwiching the first ferromagnetic portion 24A in the rotation direction R1 of the fixing belt 21. The controller 60 controls the driver 61 to move the second ferromagnetic portions 24B of the ferromagnet 24 between the first heating position shown in FIG. 11A and the second heating position shown in FIG. 11B, changing the density of a magnetic flux applied from the exciting coil unit 25 to the first heat generation layer 21*a* of the fixing belt 21.

As shown in FIG. 17, the heat generator 23T is constructed of the second heat generation layer 23*d*. As shown in FIG. 18, unlike the fixing device 20S depicted in FIG. 10, the fixing device 20T includes the separator 28 that separates the heat generator 23T from the fixing belt 21 at a predetermined time. When the separator 28 isolates the heat generator 23T from the fixing belt 21, that is, when the heat generator 23T is at a third heating position shown in FIGS. 15 and 16B, the exciting coil unit 25 heats the first heat generation layer 21*a* of the fixing belt 21 in a third heating state. In the third heating state in which the heat generator 23T is at the third heating position shown in FIGS. 15 and 16B, even if a magnetic flux generated by the exciting coil unit 25 penetrates the first heat generation layer 21*a* of the fixing belt 21 and reaches the second heat generation layer 23*d* of the heat generator 23T, the heat generator 23T heats the fixing belt 21 with decreased heating efficiency, that is, the heat generator 23T does not conduct heat generated by the second heat generation layer 23*d* thereof to the fixing belt 21. As the controller 60 controls the separator 28 to move the heat generator 23T to the third heating position shown in FIGS. 15 and 16B as needed, the controller 60 adjusts heating of the fixing belt 21 precisely.

Referring to FIG. 18, a detailed description is now given of a construction of the separator 28 that separates the heat generator 23T from the fixing belt 21.

As shown in FIG. 18, the separator 28 is constructed of a support 28*d* disposed inside the loop formed by the fixing belt 21; a spring 28*b* anchored to the heat generator 23T and the support 28*d*; and a cam 28*c* contacting the exciting coil unit 25 and the heat generator 23T. The driver 61 is connected to the cam 28*c* and the controller 60. The cam 28*c* is rotatably mounted on each of the flanges provided on lateral ends of the fixing belt 21 in the axial direction thereof. When the cam 28*c* rotates clockwise in FIG. 18, it lowers the heat generator 23T against a bias exerted by the spring 28*b* to the heat generator 23T; thus the heat generator 23T moves downward in FIG. 18 to the third heating position shown in FIGS. 15 and 16B, brought into isolation from the fixing belt 21. Conversely, when the cam 28*c* rotates counterclockwise in FIG. 18 from the third heating position shown in FIGS. 15 and 16B, it lifts the heat generator 23T; thus the heat generator 23T moves upward in FIG. 18 to a contact position shown in FIGS. 16C and 18 where the heat generator 23T contacts the fixing belt 21.

Referring to FIGS. 15, 16A, 16B, and 19, a detailed description is now given of rotation of the heat generator 23T in the circumferential direction of the fixing belt 21.

The rotating assembly 29 depicted in FIG. 19 rotates the heat generator 23T bidirectionally in the rotation direction R3 to an opposed position shown in FIGS. 16B and 19 where the heat generator 23T is disposed opposite the exciting coil unit 25 and a non-opposed position shown in FIG. 16A where the heat generator 23T is not disposed opposite the exciting coil unit 25. When the heat generator 23T is at the non-opposed position shown in FIG. 16A, a magnetic flux generated by the exciting coil unit 25 is not applied to the heat generator 23T. Thus, the controller 60 moves the heat generator 23T to the non-opposed position shown in FIG. 16A to prohibit the exciting coil unit 25 from heating the second heat generation layer 23*d* of the heat generator 23T by electromagnetic induction.

Referring to FIG. 19, a detailed description is now given of the rotating assembly 29 that rotates the heat generator 23T in the circumferential direction of the fixing belt 21.

As shown in FIG. 19, the rotating assembly 29 is constructed of a shaft 29*b* rotatably mounted on each of the flanges provided on the lateral ends of the fixing belt 21 in the axial direction thereof; and a support 29*a* attached to the heat generator 23T and the shaft 29*b*. The driver 61 is connected to the shaft 29*b* and the controller 60. The shaft 29*b* is mounted with a gear engaging a gear train connected to the driver 61. As the driver 61 rotates the shaft 29*b*, the support 29*a* mounted on the shaft 29*b* rotates the heat generator 23T clockwise or counterclockwise in FIG. 19 in the rotation direction R3.

For example, while the fixing device 20T or the image forming apparatus 1 depicted in FIG. 1 installed with the fixing device 20T is warmed up, the controller 60 controls the separator 28 and the rotating assembly 29 to move the heat generator 23T to the non-opposed position shown in FIG. 16A or the third heating position shown in FIG. 16B where the heat generator 23T is isolated from the fixing belt 21. Thus, even when the image forming apparatus 1 is cool in the morning after it has been powered off for a long time, the fixing belt 21 is heated to a desired fixing temperature quickly by isolating the heat generator 23T from the fixing belt 21 and therefore prohibiting the heat generator 23T from drawing heat from the fixing belt 21. When the heat generator 23T is at the non-opposed position shown in FIG. 16A or the third heating position shown in FIG. 16B, the controller 60 controls the driver 61 to move the second ferromagnetic portions 24B of the ferromagnet 24 to the first heating position shown in FIG. 11A where the second ferromagnetic portions 24B are spaced apart from the exciting coil unit 25 with the smaller distance H1 therebetween.

Figures 20, 21:
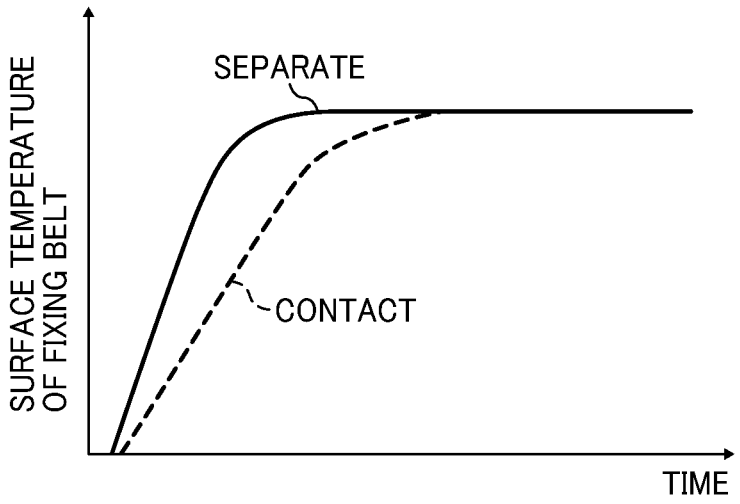
FIG. 20 is a graph showing a relation between time and a surface temperature of the fixing belt incorporated in the fixing device shown in FIG. 15.
FIG. 21 is a lookup table showing the position of the heat generator shown in FIGS. 16A to 16C based on the thickness of a recording medium and a print mode.

FIG. 20 is a graph showing a relation between time and the surface temperature of the fixing belt 21, that is, the temperature of the outer circumferential surface of the fixing belt 21 when the fixing device 20T is warmed up. The solid line in FIG. 20 shows the surface temperature of the fixing belt 21 over time in a state in which the heat generator 23T is isolated from the fixing belt 21 during warm-up as shown in FIGS. 16A and 16B. The broken line in FIG. 20 shows the surface temperature of the fixing belt 21 over time in a state in which the heat generator 23T is in contact with the fixing belt 21 during warm-up as shown in FIG. 16C. The graph shown in FIG. 20 indicates that the heat generator 23T isolated from the fixing belt 21 during warm-up allows the exciting coil unit 25 to heat the fixing belt 21 quickly.

Conversely, while a recording medium P bearing a toner image T is conveyed through the fixing nip N, the controller 60 controls the separator 28 and the rotating assembly 29 to move the heat generator 23T to the contact position shown in FIG. 16C where the heat generator 23T is in contact with the fixing belt 21. Accordingly, the exciting coil unit 25 heats the second heat generation layer 23*d* of the heat generator 23T by electromagnetic induction. Since the fixing belt 21 is already warmed up to a desired fixing temperature, the heat generator 23T heats the fixing belt 21 supplementarily to offset decrease of the temperature of the fixing belt 21. When the heat generator 23T is at the contact position shown in FIG. 16C, the controller 60 controls the driver 61 to move the second ferromagnetic portions 24B of the ferromagnet 24 to the second heating position shown in FIG. 11B where the second ferromagnetic portions 24B are spaced apart from the exciting coil unit 25 with the greater distance H2 therebetween.

If the temperature sensor 40 detects that the temperature of the fixing belt 21 is lower than the predetermined fixing temperature, the controller 60 controls the separator 28 depicted in FIG. 18 to bring the heat generator 23T into contact with the fixing belt 21 at the contact position shown in FIG. 16C. Conversely, if the temperature sensor 40 detects that the temperature of the fixing belt 21 reaches the predetermined fixing temperature, the controller 60 controls the separator 28 to separate the heat generator 23T from the fixing belt 21 at the third heating position shown in FIG. 16B. Accordingly, even if a recording medium P conveyed through the fixing nip N draws heat from the fixing belt 21 and therefore decreases the temperature of the fixing belt 21, the heat generator 23T brought into contact with the fixing belt 21 heats the fixing belt 21, offsetting decrease of the temperature of the fixing belt 21 and therefore minimizing formation of a faulty fixed toner image due to the decreased temperature of the fixing belt 21. If the temperature of the fixing belt 21 in not decreased from the predetermined fixing temperature, the controller 60 controls the separator 28 to separate the heat generator 23T from the fixing belt 21, allowing the heat generator 23T to store heat by electromagnetic induction. It is to be noted that the controls described above are applicable when a plurality of recording media P is conveyed through the fixing nip N continuously.

If a thin recording medium P having a thickness smaller than a predetermined thickness is conveyed through the fixing nip N, the controller 60 controls the separator 28 to separate the heat generator 23T from the fixing belt 21 at the third heating position shown in FIG. 16B. It is because the thin recording medium P draws less heat from the fixing belt 21, maintaining the temperature of the fixing belt 21 even if the heat generator 23T is isolated from the fixing belt 21 and thereby does not heat the fixing belt 21 supplementarily.

If the fixing device 20T is installed in a color image forming apparatus in which the color print mode to fix a color toner image T on a recording medium P and the monochrome print mode to fix a monochrome toner image T on a recording medium P are available and the user selects the monochrome print mode, the controller 60 controls the separator 28 to separate the heat generator 23T from the fixing belt 21 at the third heating position shown in FIG. 16B. It is because the monochrome toner image T on the recording medium P draws less heat from the fixing belt 21, maintaining the temperature of the fixing belt 21 even if the heat generator 23T is isolated from the fixing belt 21 and thereby does not heat the fixing belt 21 supplementarily.

FIG. 21 is a lookup table showing the position of the heat generator 23T moved by the separator 28 based on the thickness of the recording medium P and the print mode described above. As shown in FIG. 21, if a thin recording medium P having a paper weight not greater than about 80 g/cm$^2$ is used, whether the user selects the monochrome print mode or the color print mode, the controller 60 controls the separator 28 to separate the heat generator 23T from the fixing belt 21 as shown in FIG. 16B. If a medium recording medium P, generally called plain paper, having a paper weight in a range of from about 81 g/cm$^2$ to about 105 g/cm$^2$ is used in the monochrome print mode, the controller 60 controls the separator 28 to separate the heat generator 23T from the fixing belt 21 as shown in FIG. 16B. If a medium recording medium P is used in the color print mode, the controller 60 controls the separator 28 to bring the heat generator 23T into contact with the fixing belt 21 as shown in FIG. 16C. If a thick recording medium P having a paper weight not smaller than about 106 g/cm$^2$ is used, whether the user selects the monochrome print mode or the color print mode, the controller 60 controls the separator 28 to bring the heat generator 23T into contact with the fixing belt 21 as shown in FIG. 16C. The above-described control of the separator 28 based on the thickness of the recording medium P and the print mode reduces wear of the fixing belt 21 and the heat generator 23T due to friction therebetween. The thickness of the recording medium P is detected directly by a thickness sensor located in a recording medium conveyance path and in proximity to the paper trays 12 to 14 depicted in FIG. 1 or indirectly from information of a print job input by the user using the control panel of the image forming apparatus 1. Thus, the controller 60 performs the control described above based on the thickness of the recording medium P detected by the thickness sensor or the control panel.

The fixing device 20T provides a plurality of temperature modes including an enhanced temperature mode in which the fixing belt 21 is heated to an enhanced, first target temperature suitable for fixing a toner image T on a thick recording medium P and a reduced temperature mode in which the fixing belt 21 is heated to a reduced, second target temperature that is lower than the first target temperature and suitable for fixing a toner image T on a thin or medium recording medium P. In the enhanced temperature mode, the controller 60 controls the separator 28 to move the heat generator 23T to bring the heat generator 23T into contact with the fixing belt 21 as shown in FIG. 16C. In the reduced temperature mode, the controller 60 controls the separator 28 to separate the heat generator 23T from the fixing belt 21 as shown in FIG. 16B. If the heat generator 23T still contacts the fixing belt 21 as shown in FIG. 16C even when the fixing device 20T switches from the enhanced temperature mode to the reduced temperature mode, the heat generator 23T contacting the fixing belt 21 may heat the fixing belt 21. Accordingly, it may take longer to decrease the temperature of the fixing belt 21 from the higher, first target temperature to the lower, second target temperature. To address this problem, the fixing device 20T performs the control described above, shortening the switch time required to decrease the temperature of the fixing belt 21 from the first target temperature of the enhanced temperature mode to the second target temperature of the reduced temperature mode.

FIG. 22 is a graph showing a relation between time and the surface temperature of the fixing belt 21 when the fixing device 20T switches from the enhanced temperature mode to the reduced temperature mode with a desired control of separating the heat generator 23T from the fixing belt 21 and a comparative control of bringing the heat generator 23T into contact with the fixing belt 21.

The solid line in FIG. 22 indicates the temperature of the fixing belt 21 when the heat generator 23T is isolated from the fixing belt 21 at an isolation position shown in FIGS. 16A and 16B as the temperature mode is switched from the enhanced temperature mode to the reduced temperature mode. The broken line in FIG. 22 indicates the temperature of the fixing belt 21 when the heat generator 23T contacts the fixing belt 21 at the contact position shown in FIG. 16C as the temperature mode is switched from the enhanced temperature mode to the reduced temperature mode. The first target temperature of the fixing belt 21 is about 180 degrees centigrade in the enhanced temperature mode used for a thick recording medium P; the second target temperature of the fixing belt 21 is about 165 degrees centigrade in the reduced temperature mode used for a thin or medium recording medium P. As shown in FIG. 22, the desired control of separating the heat generator 23T from the fixing belt 21 shortens the switch time required to switch the temperature mode from the enhanced temperature mode to the reduced temperature mode.

If the temperature of the fixing belt 21 exceeds the predetermined fixing temperature, that is, if the temperature sensor 40 detects overheating of the fixing belt 21, while the heat generator 23T contacts the fixing belt 21 at the contact position shown in FIG. 16C, the controller 60 controls the separator 28 to separate the heat generator 23T from the fixing belt 21 at the isolation position shown in FIG. 16B. Accordingly, the heat generator 23T does not heat the fixing belt 21, facilitating cooling of the overheated fixing belt 21.

FIG. 23 is a graph showing a relation between time and the surface temperature of the fixing belt 21 when the fixing belt 21 overheats with a desired control of separating the heat generator 23T from the fixing belt 21 and a comparative control of bringing the heat generator 23T into contact with the fixing belt 21.

The solid line in FIG. 23 indicates the temperature of the fixing belt 21 when the heat generator 23T is isolated from the fixing belt 21 at the isolation position shown in FIGS. 16A and 16B when the fixing belt 21 overheats. The broken line in FIG. 23 indicates the temperature of the fixing belt 21 when the heat generator 23T contacts the fixing belt 21 at the contact position shown in FIG. 16C when the fixing belt 21 overheats. The fixing belt 21 is subject to overheating in the enhanced temperature mode used to heat a thick recording medium P to the enhanced, first target temperature of about 180 degrees centigrade. In the enhanced temperature mode, if the temperature sensor 40 detects that the temperature of the fixing belt 21 exceeds a predetermined temperature of about 195 degrees centigrade, for example, the controller 60 determines that the fixing belt 21 overheats and therefore controls the separator 28 to separate the heat generator 23T from the fixing belt 21, thus preventing the temperature of the fixing belt 21 from reaching an upper temperature limit of about 225 degrees centigrade. The graph shown in FIG. 23 indicates that the heat generator 23T isolated from the overheated fixing belt 21 prevents thermal damage of the fixing belt 21.

If the fixing device 20T is installed in the image forming apparatus 1 having a different print productivity, that is, employing a different conveyance speed or a process linear velocity at which a recording medium P is conveyed as a compatible unit, the condition (e.g., the thickness of a recording medium P and the print mode) based on which the separator 28 separates the heat generator 23T from the fixing belt 21 as shown in FIG. 16B may be changed. For example, a recording medium P conveyed at a decreased speed draws less heat from the fixing belt 21 than a recording medium P conveyed at an increased speed. Hence, even if the heat generator 23T is isolated from the fixing belt 21 and therefore does not heat the fixing belt 21, the fixing belt 21 maintains the predetermined fixing temperature. Thus, the fixing device 20T is installable in various image forming apparatuses configured to convey a recording medium P at different speeds as a compatible fixing device.

FIG. 24 is a lookup table showing the position of the heat generator 23T moved by the separator 28 based on the thickness of the recording medium P and the recording medium conveyance speed.

For example, the lookup table shows the desired position of the heat generator 23T for three thicknesses of the recording medium P, that is, a thin recording medium P, a medium recording medium P, and a thick recording medium P and three image forming apparatuses $\alpha$ to $\gamma$ that convey the recording medium P at three speeds, respectively. As shown in FIG. 24, in the image forming apparatus $\alpha$ that conveys the recording medium P at a lowest speed of conveying 31 sheets of A4 size recording media P per minute, the controller 60 controls the separator 28 to separate the heat generator 23T from the fixing belt 21 if the image forming apparatus $\alpha$ conveys a thin recording medium P having a paper weight not greater than about 80 g/cm$^2$ and a medium recording medium P having a paper weight in a range of from about 81 g/cm$^2$ to about 105 g/cm$^2$. Conversely, the controller 60 controls the separator 28 to bring the heat generator 23T into contact with the fixing belt 21 if the image forming apparatus $\alpha$ conveys a thick recording medium P having a paper weight not smaller than about 106 g/cm$^2$. In the image forming apparatus $\beta$ that conveys the recording medium P at a medium speed of conveying 41 sheets of A4 size recording media P per minute, the controller 60 controls the separator 28 to separate the heat generator 23T from the fixing belt 21 if the image forming apparatus $\beta$ conveys a thin recording medium P. Conversely, the controller 60 controls the separator 28 to bring the heat generator 23T into contact with the fixing belt 21 if the image forming apparatus $\beta$ conveys a medium recording medium P and a thick recording medium P. In the image forming apparatus γ that conveys the recording medium P at a highest speed of conveying 51 sheets of A4 size recording media P per minute, the controller 60 controls the separator 28 to bring the heat generator 23T into contact with the fixing belt 21 if the image forming apparatus γ conveys a recording medium P of any thickness. Thus, the fixing device 20T is installable in various image forming apparatuses α to γ configured to convey a recording medium P at different speeds as a compatible fixing device.

Figure 25A:
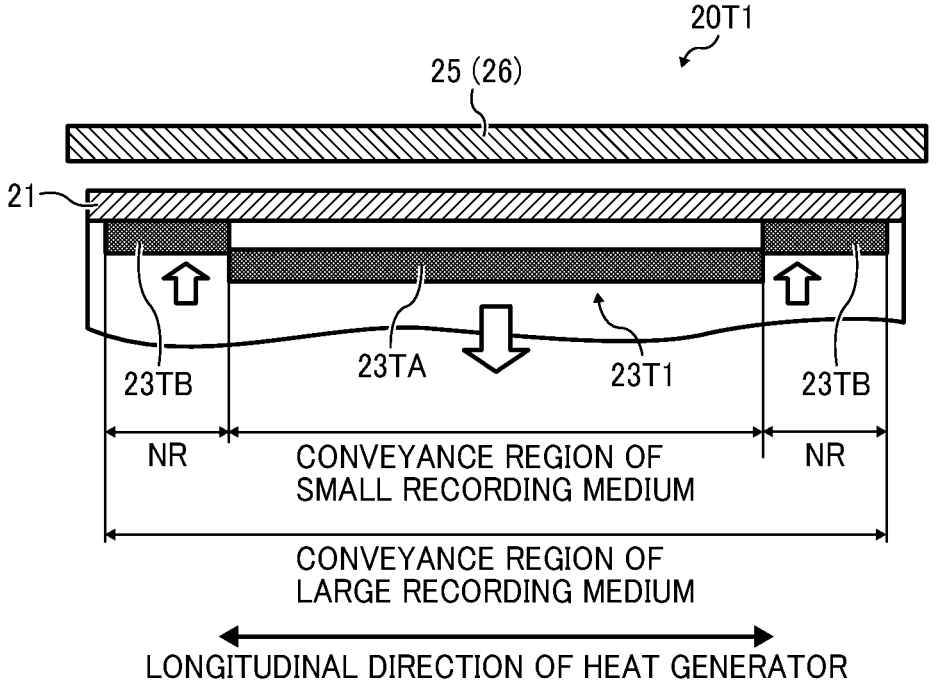
FIG. 25A is a horizontal sectional view of a fixing device as a variation of the fixing device shown in FIG. 15 at a first heating position for heating a fixing belt incorporated therein.
Figure 25B:
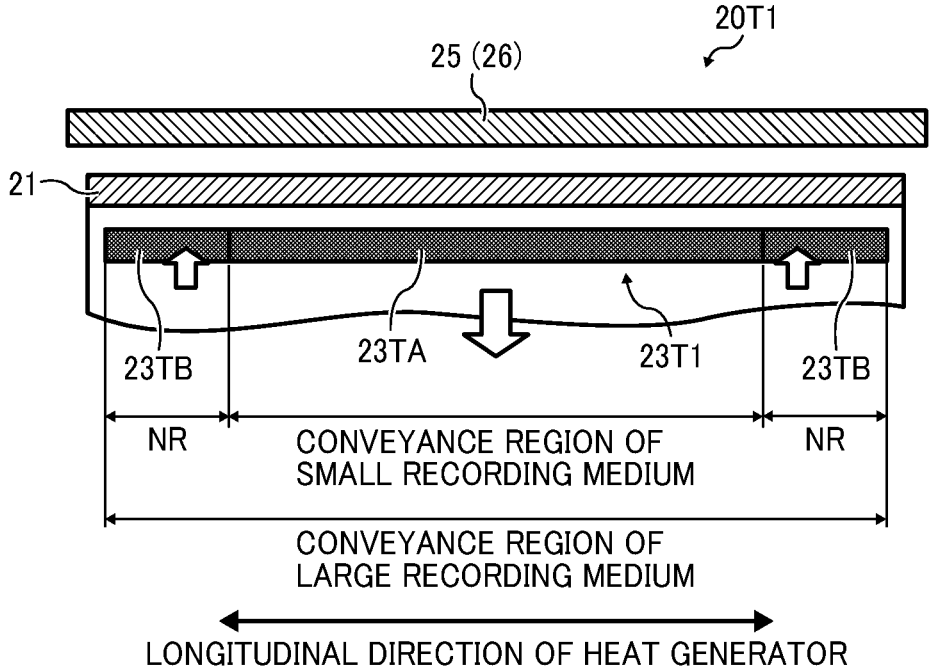
FIG. 25B is a horizontal sectional view of the fixing device shown in FIG. 25A at a second heating position for heating the fixing belt.

Alternatively, the heat generator 23T may be divided into a plurality of portions that corresponds to various sizes of recording media P in a width direction thereof parallel to the axial direction of the fixing belt 21 as shown in FIGS. 25A and 25B.

Referring to FIGS. 25A and 25B, the following describes a configuration of a fixing device 20T1 incorporating a heat generator 23T1 divided into a plurality of portions.

FIG. 25A is a horizontal sectional view of the fixing device 20T1 at a first heating position for heating the fixing belt 21. FIG. 25B is a horizontal sectional view of the fixing device 20T1 at a second heating position for heating the fixing belt 21. As shown in FIGS. 25A and 25B, the heat generator 23T1 includes a center heat generation portion 23TA and lateral heat generation portions 23TB contiguous to and sandwiching the center heat generation portion 23TA in the axial direction of the fixing belt 21. The center heat generation portion 23TA and the lateral heat generation portions 23TB are separatably in contact with the fixing belt 21. Thus, the controller 60 depicted in FIG. 15 controls the separator 28 depicted in FIG. 18 to move the center heat generation portion 23TA and the lateral heat generation portions 23TB with respect to the fixing belt 21 according to the size of the recording medium P.

For example, the center heat generation portion 23TA is disposed at a center of the heat generator 23T1 in a longitudinal direction thereof parallel to the axial direction of the fixing belt 21, that corresponds to the conveyance region of a small recording medium P, and is separatably in contact with a center of the fixing belt 21 in the axial direction thereof. Each of the lateral heat generation portions 23TB is disposed at each lateral end of the heat generator 23T1 in the longitudinal direction thereof, that corresponds to the non-conveyance region NR of a small recording medium P, and is separatably in contact with each lateral end of the fixing belt 21 in the axial direction thereof. The controller 60 controls the separator 28 to separate the center heat generation portion 23TA from the fixing belt 21 independently from the lateral heat generation portions 23TB according to the size of the recording medium P conveyed through the fixing nip N. Accordingly, even after a plurality of small recording media P is conveyed through the fixing nip N continuously, the non-conveyance regions NR on the fixing belt 21 where the small recording media P do not pass do not overheat due to absence of large recording media P that draw heat from the non-conveyance regions NR on the fixing belt 21 as described above with reference to FIG. 7.

For example, immediately after a plurality of small recording media P is conveyed through the fixing nip N continuously in a state in which the center heat generation portion 23TA and the lateral heat generation portions 23TB are isolated from the fixing belt 21 as shown in FIG. 25B, both lateral ends of the fixing belt 21 in the axial direction thereof may overheat because the small recording media P do not draw heat from the non-conveyance regions NR on both lateral ends of the fixing belt 21 in the axial direction thereof. To address this circumstance, the lateral heat generation portions 23TB contact the non-conveyance regions NR on both lateral ends of the fixing belt 21 in the axial direction thereof as shown in FIG. 25A, drawing heat from the non-conveyance regions NR on the fixing belt 21 and therefore preventing overheating of both lateral ends of the fixing belt 21 in the axial direction thereof.

The above-described configuration of the center heat generation portion 23TA and the lateral heat generation portions 23TB is one example and modifiable according to various conditions. For example, the heat generator 23T1 is divided into the center heat generation portion 23TA and the lateral heat generation portions 23TB that correspond to two sizes of recording media P, that is, the small recording medium P and the large recording medium P. Alternatively, the heat generator 23T1 may be divided into three or more heat generation portions that correspond to three or more sizes of recording media P.

The fixing devices 20T and 20T1 depicted in FIGS. 15 and 25A, respectively, with the configurations described above, like the fixing device 20S depicted in FIG. 10, incorporate the controller 60 that controls the separator 28 and the rotating assembly 29 to move the heat generators 23T and 23T1 with respect to the fixing belt 21, thus changing the density of a magnetic flux applied from the exciting coil unit 25 to the first heat generation layer 21*a* of the fixing belt 21. For example, at the first heating position shown in FIG. 16A and the third heating position shown in FIG. 16B, that is, at the isolation position, the exciting coil unit 25 heats the first heat generation layer 21*a* of the fixing belt 21 only by electromagnetic induction, thus heating the fixing belt 21 directly. Conversely, at the second heating position shown in FIG. 16C, that is, at the contact position, the exciting coil unit 25 heats both the first heat generation layer 21*a* of the fixing belt 21 and the second heat generation layer 23*d* of the heat generator 23T or 23T1 by electromagnetic induction, thus heating the fixing belt 21 directly and at the same time heating the fixing belt 21 indirectly via the heat generator 23T or 23T1. Accordingly, the heat generators 23T and 23T1 improve heating efficiency for heating the fixing belt 21 by electromagnetic induction and thereby heat the fixing belt 21 quickly.

According to the example embodiments described above, the pressing roller 31 serves as a pressing rotary body and the fixing belt 21 serves as a fixing rotary body. Alternatively, the pressing rotary body may be a pressing belt or the like and the fixing rotary body may be a fixing film, a fixing roller, or the like. Further, according to the example embodiments described above, the image forming apparatus 1 installed with the fixing device 20, 20S, 20S1, 20S2, 20T, or 20T1 is a monochrome image forming apparatus. Alternatively, the image forming apparatus 1 may be a color image forming apparatus installed with the fixing device 20, 20S, 20S1, 20S2, 20T, or 20T1.

As shown in FIGS. 10, 11A, and 11B, the ferromagnet 24 is divided into the first ferromagnetic portion 24A and the second ferromagnetic portions 24B. The controller 60 controls the driver 61 to move the second ferromagnetic portions 24B with respect to the exciting coil unit 25 in a direction orthogonal to the axial direction of the fixing belt 21 between the first heating position where the exciting coil unit 25 heats the first heat generation layer 21*a* of the fixing belt 21 only in the first heating state and the second heating position where the exciting coil unit 25 heats both the first heat generation layer 21*a* of the fixing belt 21 and the second heat generation layer 23*d* of the heat generator 23S in the second heating state. Alternatively, division and movement of the ferromagnet 24 are modifiable in such a manner that the density of a magnetic flux applied to the first heat generation layer 21*a* of the fixing belt 21 is changeable and the exciting coil unit 25 heats the first heat generation layer 21*a* of the fixing belt 21 in the first heating state and heats the first heat generation layer 21*a* of the fixing belt 21 and the second heat generation layer 23*d* of the heat generator 23, 23S, 23S1, 23S2, 23T, or 23T1 in the second heating state that are switchable, thus attaining the advantages described above.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device comprising:

a first rotary body including a first layer;

a second rotary body pressed against the first rotary body and configured to form a nip through which a recording medium bearing a toner image is conveyed;

a heat generator contacting an inner circumferential surface of the first rotary body and including a second layer;

a coil unit disposed opposite the heat generator with reference to the first rotary body; and a ferromagnet opposite the coil unit with reference to the heat generator and the first rotary body, the ferromagnet including a stationary first ferromagnetic portion and a movable second ferromagnetic portion, the ferromagnet being configured to be movable between a first position, where the ferromagnet is configured to cause a magnetic flux generated by the coil unit to heat the first layer, and a second position where the ferromagnet is configured to cause the magnetic flux to heat the first layer and the second layer.

2. The fixing device according to claim 1, wherein the stationary first ferromagnetic portion is at a first distance from the coil unit, the movable second ferromagnetic portion is adjacent the stationary first ferromagnetic portion in a direction of rotation of the first rotary body, when the stationary first ferromagnetic portion and the movable second ferromagnetic portion are at the first position, the ferromagnet is configured to cause the magnetic flux to heat the first layer, when the movable second ferromagnetic portion moves from the first position to the second position to be at a second distance from the coil unit, the ferromagnet is configured to cause the magnetic flux to heat the first layer and the second layer, and the second distance greater than the first distance.

3. The fixing device according to claim , wherein the ferromagnet, at the first position, is configured to cause a density of the magnetic flux applied to the first layer to be smaller than a saturation magnetic flux of the first layer, and the ferromagnet, at the second position, is configured to cause the density of the magnetic flux applied to the first layer to be greater than the saturation magnetic flux.

4. The fixing device according to claim 1, wherein the ferromagnet is at the first position during warm-up of the first device and at the second position when a plurality of recording media is conveyed through the nip continuously.

5. The fixing device according to claim 1, further comprising:

a separator attached to the heat generator and configured to move the heat generator in a diametrical direction of the first rotary body between an isolation position where the heat generator is isolated from the first rotary body and a contact position where the heat generator is in contact with the first rotary body.

6. The fixing device according to claim 5, wherein the separator is configured to move the heat generator to the isolation position to warm up the fixing device, form a monochrome toner image on the recording medium, or convey a recording medium having a thickness not greater than a predetermined thickness through the fixing nip.

7. The fixing device according to claim 5, wherein the separator is configured to move the heat generator to the isolation position to decrease a temperature of the first rotary body.

8. The fixing device according to claim 5, wherein the separator is configured to move the heat generator to the isolation position after the first rotary body is heated to a temperature.

9. The fixing device according to claim 5, wherein the heat generator further includes:

a center heat generation portion opposite a center of the fixing rotary body in an axial direction thereof; and a lateral heat generation portion opposite each lateral end of the fixing rotary body in the axial direction thereof and contiguous to the center heat generation portion in the axial direction of the first rotary body, wherein the separator is configured to move the lateral heat generation portion of the heat generator according to a size of the recording medium.

10. The fixing device according to claim 9, wherein the separator is configured to move the lateral heat generation portion of the heat generator to the contact position after a plurality of decreased size recording media is conveyed through the fixing nip continuously.

11. The fixing device according to claim 5, further comprising;

a rotating assembly attached to the heat generator and configured to move the heat generator in a circumferential direction of the first rotary body between an opposed position where the heat generator is disposed opposite the exciting coil unit and a non-opposed position where the heat generator is not disposed opposite the exciting coil unit.

12. The fixing device according to claim 5, wherein the separator is configured to move the heat generator to the contact position when the recording medium is conveyed through the fixing nip at an increased speed.

13. An image forming apparatus comprising:

the fixing device according to claim 1.

14. The fixing device according to claim 1, wherein the first and second rotary bodies are configured to rotate in opposite directions.

15. The fixing device according to claim 1, wherein the fixing device further comprises:

a controller connected to the ferromagnet and configured to move the ferromagnet between the first and second positions.

16. The fixing device according to claim 1, wherein when the ferromagnet is in the first position, the magnetic flux is configured to heat only the first layer.

17. The fixing device according to claim 1, wherein when the ferromagnet is in the first position, the magnetic flux does not heat the second layer.

18. A fixing device comprising:

a first rotary body including a first layer;

a second rotary body pressed against the first rotary body and configured to form a nip through which a recording medium bearing a toner image is conveyed;

a heat generator contacting an inner circumferential surface of the first rotary body and including a second layer;

a coil unit disposed opposite the heat generator with reference to the first rotary body; and a ferromagnet opposite the coil unit with reference to the heat generator and the first rotary body, the ferromagnet being configured to be movable between a first position, where the ferromagnet causes a magnetic flux generated by the coil unit to heat the first layer, and a second position where the ferromagnet causes the magnetic flux to heat the first layer and the second layer, the ferromagnet including, a stationary first ferromagnetic portion at a first distance from the coil unit and a second ferromagnetic portion adjacent the first ferromagnetic portion in a direction of rotation of the first rotary body, wherein when the stationary first ferromagnetic portion and the second ferromagnetic portion are at the first position, the ferromagnet is configured to cause the magnetic flux to heat the first layer, when the second ferromagnetic portion moves from the first position to the second position to be at a second distance from the coil unit, the ferromagnet is configured to cause the magnetic flux to heat the first layer and the second layer, and the second distance is greater than the first distance.

* * * * *